US012104314B2

(12) United States Patent
Kim et al.

(10) Patent No.: US 12,104,314 B2
(45) Date of Patent: Oct. 1, 2024

(54) CLOTHES FOLDING APPARATUS

(71) Applicant: LG Electronics Inc., Seoul (KR)

(72) Inventors: Jeongyun Kim, Seoul (KR); Keunjoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 216 days.

(21) Appl. No.: 17/778,646

(22) PCT Filed: Nov. 10, 2020

(86) PCT No.: PCT/KR2020/015680
§ 371 (c)(1),
(2) Date: May 20, 2022

(87) PCT Pub. No.: WO2021/101150
PCT Pub. Date: May 27, 2021

(65) Prior Publication Data

US 2022/0396913 A1 Dec. 15, 2022

(30) Foreign Application Priority Data

Nov. 20, 2019 (KR) ..... 10-2019-0149387

(51) Int. Cl.
*D06F 89/02* (2006.01)

(52) U.S. Cl.
CPC ..... *D06F 89/02* (2013.01)

(58) Field of Classification Search
CPC .. A41H 43/025; A41H 43/0257; D06F 89/00; D06F 89/02; D06F 89/023
See application file for complete search history.

(56) References Cited

U.S. PATENT DOCUMENTS 3,419,261 A * 12/1968 Sjostrom ..... D06F 89/00 493/23
5,540,647 A * 7/1996 Weiermann ..... D06F 89/00 493/938

(Continued)

FOREIGN PATENT DOCUMENTS

CN 108532261 9/2018
DE 102018205731 10/2019

(Continued)

OTHER PUBLICATIONS

Extended European Search Report in European Appln. No. 20889234.9, mailed on Oct. 30, 2023, 9 pages.

(Continued)

*Primary Examiner* — F Griffin Hall
(74) *Attorney, Agent, or Firm* — Fish & Richardson P.C.

(57) ABSTRACT

The present disclosure relates to a garment folding apparatus, i.e., a folding apparatus that serves to fold a garment during a process of conveying the garment. A folding assembly constituting the garment folding apparatus includes a vertical folding layer having a conveyor and configured to vertically fold the loaded garment by using a drive motor, a horizontal folding layer disposed below the vertical folding layer, having a conveyor, and configured to horizontally fold the loaded garment by using a drive motor, and sensor units provided in the vertical folding layer and the horizontal folding layer and configured to detect the garment so as to check whether the garment is loaded, a length of the garment, and whether the garment is folded.

11 Claims, 23 Drawing Sheets

(56) References Cited

U.S. PATENT DOCUMENTS

| | | | | |
|---|---|---|---|---|
| 6,241,232 | B1 * | 6/2001 | Schmitt | B65B 63/04 493/413 |
| 6,915,929 | B2 * | 7/2005 | Rauch | D06F 89/00 223/37 |
| 2019/0292718 | A1 * | 9/2019 | Maeshima | D06F 89/00 |
| 2019/0309465 | A1 * | 10/2019 | Rozov | A41H 43/0257 |
| 2020/0248397 | A1 * | 8/2020 | Nitschmann | B65H 29/16 |
| 2020/0385918 | A1 * | 12/2020 | Naor | D06F 89/00 |
| 2021/0071353 | A1 * | 3/2021 | Gabai | D06F 89/02 |
| 2021/0207316 | A1 * | 7/2021 | Maeshima | D06F 89/00 |

FOREIGN PATENT DOCUMENTS

| | | |
|---|---|---|
| JP | 2002119800 | 4/2002 |
| JP | 2006160427 | 6/2006 |
| KR | 20120095922 | 8/2012 |
| KR | 20170095620 | 8/2017 |
| WO | WO2019038752 | 2/2019 |

OTHER PUBLICATIONS

International Search Report in International Appln. No. PCT/KR2020/015680, dated Feb. 15, 2021, 5 pages (with English translation).

* cited by examiner

CLOTHES FOLDING APPARATUS

CROSS-REFERENCE TO RELATED APPLICATIONS

This application is a National Stage application under 35 U.S.C. § 371 of International Application No. PCT/KR2020/015680, filed on Nov. 10, 2020, which claims the benefit of Korean Application No. 10-2019-0149387, filed on Nov. 20, 2019. The disclosures of the prior applications are incorporated by reference in their entirety.

TECHNICAL FIELD

The present disclosure relates to an automated apparatus for folding a garment.

BACKGROUND ART

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automated apparatus (hereinafter, referred to as a 'garment folding apparatus') capable of quickly and uniformly performing a process of folding garments. PCT International Patent Application Laid-Open No. 2018-122841 (entitled DOMESTIC COMPACT ARTICLE FOLDING MACHINE HAVING STACKED CONVEYOR LAYERS AND FOLDING METHOD THEREFOR) (hereinafter, referred to as the 'related art document') has been published on Jul. 5, 2018, in respect to the garment folding apparatus in the related art. The related art document discloses a technology related to an automated apparatus in which a garment is loaded into an upper side of the automated apparatus, folded, and unloaded from a lower side of the automated apparatus.

However, the apparatus of the related art document may have the following several technical problems.

First, because of a height or volume of the apparatus, it is difficult to install the apparatus in a limited indoor space such as homes and offices. In the case of the apparatus of the related art document, the layers for folding the garment in a stepwise manner are stacked vertically. However, there is a structural limitation in that each of the layers may fold the garment only once. For this reason, the height or volume of the apparatus inevitably increases in order to fold the garment multiple times. In addition, a layer or assembly, which is regardless of the folding process, is inserted into the apparatus, which causes an increase in height or volume of the apparatus.

Second, there are limitations in terms of a range of the garments that can be folded and intended folding sizes and shapes. In the case of the apparatus of the related art document, if a garment having a predetermined thickness or more or a long length is loaded into the apparatus, a problem may occur during a process of conveying or folding the garment, or reliability of the apparatus may deteriorate because of deterioration in folding quality. In other words, the apparatus of the related art document has a limitation in folding various types of garments having various thicknesses to desired sizes and shapes.

DISCLOSURE

Technical Problem

The present disclosure has been made in an effort to solve the above-mentioned problems of the garment folding apparatus, and an object of the present disclosure is to provide a garment folding apparatus capable of increasing a range of available garments, ensuring reliability and diversity in folding garments, and contributing to a reduction in size of the apparatus.

Regarding the reduction in size of the apparatus, an object of the present disclosure is to provide a garment folding apparatus, in which a structural change is applied in respect to arrangements of a vertical folding assembly, a horizontal folding assembly, and a conveyor, which constitute multiple layers, in order to minimize an overall height or volume of the apparatus.

Regarding the folding quality with diversity and reliability, an object of the present disclosure is to provide a garment folding apparatus capable of conforming to garments having various sizes and shapes, performing an accurate folding process in accordance with the intention, and thus having a means capable of quickly detecting a length of the garment, whether the garment is loaded, or whether the garment is folded.

Furthermore, another object of the present disclosure is to provide a garment folding apparatus capable of facilitating maintenance and heat dissipation and stably supporting multiple layers.

Technical Solution

To achieve the reduction in size of the apparatus, ensure the folding quality with diversity and reliability, and achieve the other objects, an embodiment of the present invention provides a garment folding apparatus, which serves to fold a garment during a process of conveying the garment, the garment folding apparatus including: a loading assembly configured to load a garment; a folding assembly configured to fold the loaded garment while conveying the garment; and an unloading assembly disposed below the folding assembly and configured to unload a completely folded garment, in which the folding assembly includes: a vertical folding layer having a conveyor and configured to vertically fold the loaded garment by using a drive motor; a horizontal folding layer disposed below the vertical folding layer, having a conveyor, and configured to horizontally fold the loaded garment by using a drive motor; and sensor units provided in the vertical folding layer and the horizontal folding layer and configured to detect the garment so as to check whether the garment is loaded, a length of the garment, and whether the garment is folded, and in which the conveyor of the vertical folding layer and the conveyor of the horizontal folding layer are disposed in a zigzag manner.

To achieve the reduction in size of the apparatus, ensure the folding quality with diversity and reliability, and achieve the other objects, another embodiment of the present invention provides a garment folding apparatus, which serves to fold a garment during a process of conveying the garment, the garment folding apparatus including: a folding assembly configured to fold a loaded garment while conveying the garment, in which the folding assembly includes: a first folding layer having a conveyor and configured to vertically fold the loaded garment; a second folding layer disposed below the first folding layer and configured to selectively vertically fold the loaded garment by using a drive motor; a third folding layer disposed below the second folding layer and configured to selectively horizontally fold the loaded garment by using a drive motor; a fourth folding layer disposed below the third folding layer and configured to horizontally fold the loaded garment at least once by using a drive motor; and sensor units provided in the vertical folding layer and the horizontal folding layer and configured to detect the garment so as to check whether the garment is loaded, a length of the garment, and whether the garment is folded, and in which the conveyors of the first to fourth folding layers are disposed in a zigzag manner.

To achieve the reduction in size of the apparatus, an upper conveyor and a lower conveyor may be disposed in a staggered manner with a predetermined space in a horizontal direction so that the garment dropped from the upper conveyor is loaded directly onto the lower conveyor adjacent to the upper conveyor.

To ensure the folding quality with diversity and reliability and achieve the other objects, the vertical folding layer may include a vertical folding guide unit. In addition, the vertical folding guide unit may include: a guide blade elongated in a conveyance direction; and a guide frame configured to support the guide blade on the conveyor. In addition, according to the embodiment of the present disclosure, the guide blade may be changed in position in a width direction by the drive motor.

To achieve the reduction in size of the apparatus, ensure the folding quality with diversity and reliability, and achieve the other objects, the sensor unit may include a garment detection sensor configured as an IR sensor. In addition, the garment detection sensor may be disposed above the conveyor of the vertical folding layer and emit infrared rays upward. In addition, the garment detection sensor of the vertical folding layer may be provided between conveyor belts. In addition, the garment detection sensor may protrude from a lower side of the conveyor of the horizontal folding layer and emit infrared rays horizontally.

Advantageous Effect

According to at least one of the embodiments of the present disclosure, the plurality of folding layers is provided, such that the process of folding the garment to an intended size and shape is implemented to conform to various types of garments having various thicknesses, thereby increasing the range of available garments.

According to at least one of the embodiments of the present disclosure, the garment detection sensor is provided, such that it is possible to simply and quickly check whether the garment is loaded, a length of the garment, and whether the garment is folded.

According to at least one of the embodiments of the present disclosure, the garment detection sensor is provided, such that the vertical folding process is perfectly implemented even though a length of the garment is longer than a length of the vertical folding assembly.

According to at least one of the embodiments of the present disclosure, the vertical folding guide unit is provided, such that it is possible to treat the garments having various sizes and shapes, thereby performing the intended accurate vertical folding process.

According to at least one of the embodiments of the present disclosure, one or two or more folding gaps are formed by the conveyor, such that the horizontal folding process, which conforms to various sizes and shapes, may be implemented in a limited horizontal space.

According to at least one of the embodiments of the present disclosure, the two or more conveyors are disposed to be adjacent to each other in the horizontal direction, such that the garment may be conveyed to the lower folding layer without being folded. Therefore, it is possible to implement the horizontal folding process that conforms to various sizes and shapes.

According to at least one of the embodiments of the present disclosure, the configuration of the conveyor of the horizontal folding layer may contribute to the simplification of the folding process and the reduction in size of the apparatus.

According to at least one of the embodiments of the present disclosure, the conveyors are disposed in a zigzag manner, and a space in which the garment dropped from the upper container may be received directly by the lower container is ensured, thereby preventing a bottleneck situation.

According to at least one of the embodiments of the present disclosure, the conveyors are disposed in a zigzag manner, thereby reducing costs and contributing to the reduction in size of the apparatus.

According to at least one of the embodiments of the present disclosure, the conveyors are disposed in a zigzag manner, and the sensor units are provided, such that the garment may be efficiently and normally dropped and loaded.

According to at least one of the embodiments of the present disclosure, the drive motor unit is provided, such that the maintenance and heat dissipation are facilitated.

According to at least one of the embodiments of the present disclosure, the frame is provided, such that the folding assembly may be stably supported so that the folding function may be smoothly performed.

According to at least one of the embodiments of the present disclosure, the frame is provided, such that the operating assembles of the two folding layers are simultaneously supported. Therefore, it is possible to reduce a required space and contribute to the reduction in size of the folding apparatus.

An additional range of the applicability of the present disclosure will become apparent from the following detailed description. However, various alterations and modifications may be clearly understood by those skilled in the art without departing from the spirit and scope of the present disclosure. Accordingly, it should be understood that the detailed description and the specific embodiments such as the exemplary embodiments of the present disclosure are just provided for illustrative purposes.

BEST MODE

Figure 1:
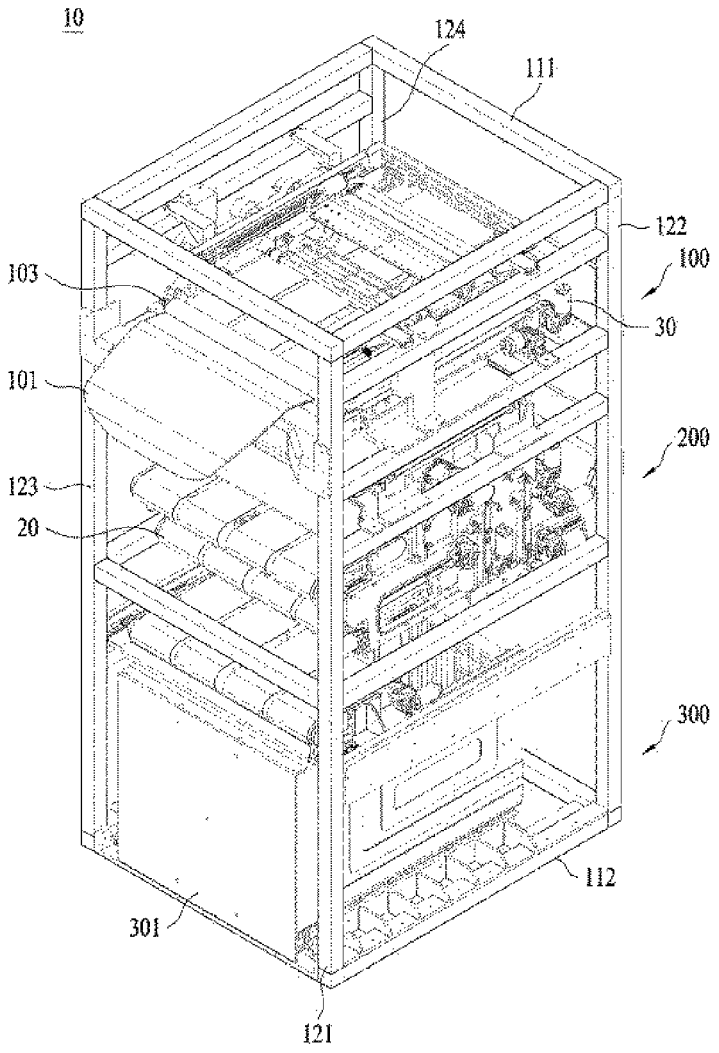
FIG. 1 is a perspective view of a garment folding apparatus according to an embodiment of the present disclosure.

Hereinafter, embodiments disclosed in the present specification will be described in detail with reference to the accompanying drawings. The same or similar constituent elements are assigned with the same reference numerals regardless of reference numerals, and the repetitive description thereof will be omitted. The suffixes 'assembly', 'unit', 'part', and 'portion' used to describe constituent elements in the following description are used together or interchangeably in order to facilitate the description, but the suffixes themselves do not have distinguishable meanings or functions. In addition, in the description of the embodiment disclosed in the present specification, the specific descriptions of publicly known related technologies will be omitted when it is determined that the specific descriptions may obscure the subject matter of the embodiment disclosed in the present specification. In addition, it should be interpreted that the accompanying drawings are provided only to allow those skilled in the art to easily understand the embodiments disclosed in the present specification, and the technical spirit disclosed in the present specification is not limited by the accompanying drawings, and includes all alterations, equivalents, and alternatives that are included in the spirit and the technical scope of the present disclosure.

The terms including ordinal numbers such as 'first', 'second', and the like may be used to describe various constituent elements, but the constituent elements are not limited by the terms. These terms are used only to distinguish one constituent element from another constituent element.

When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

Singular expressions include plural expressions unless clearly described as different meanings in the context.

Figure 2:
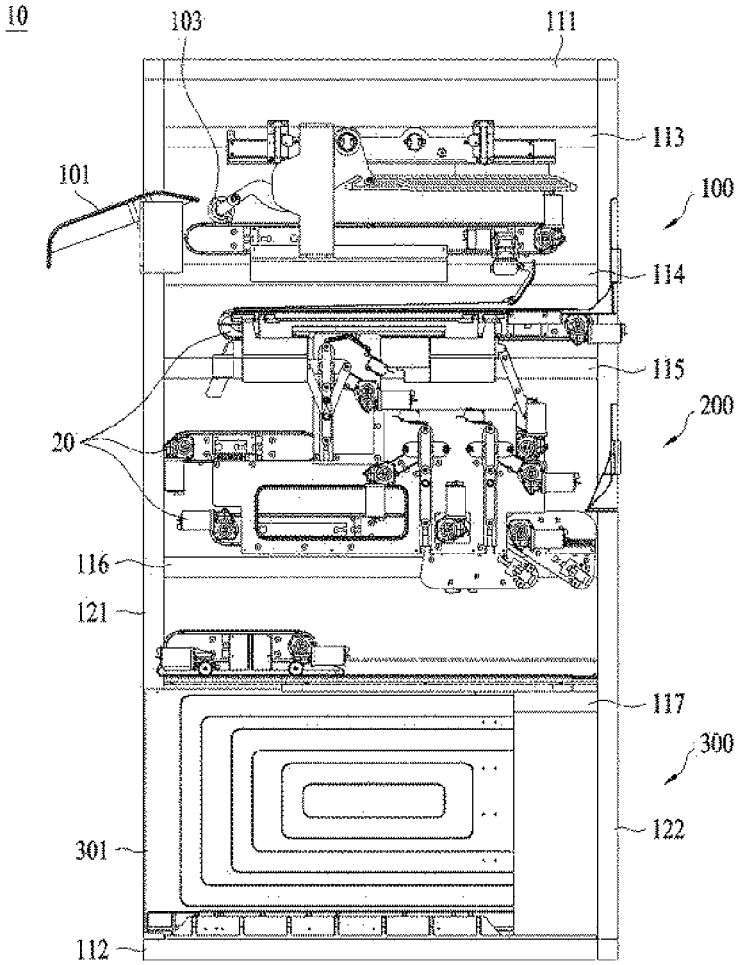
FIG. 2 is a side view of the garment folding apparatus in FIG. 1.
Figure 3:
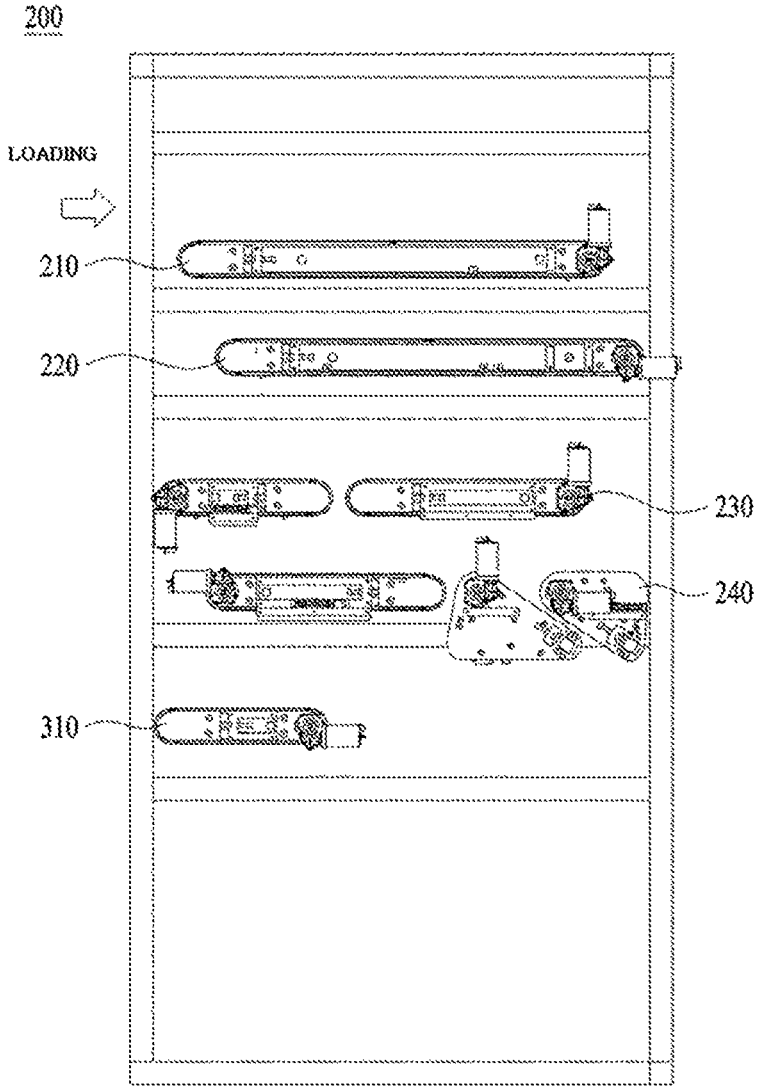
FIG. 3 is a side view illustrating a configuration of a folding assembly according to the embodiment of the present disclosure.
Figure 4:
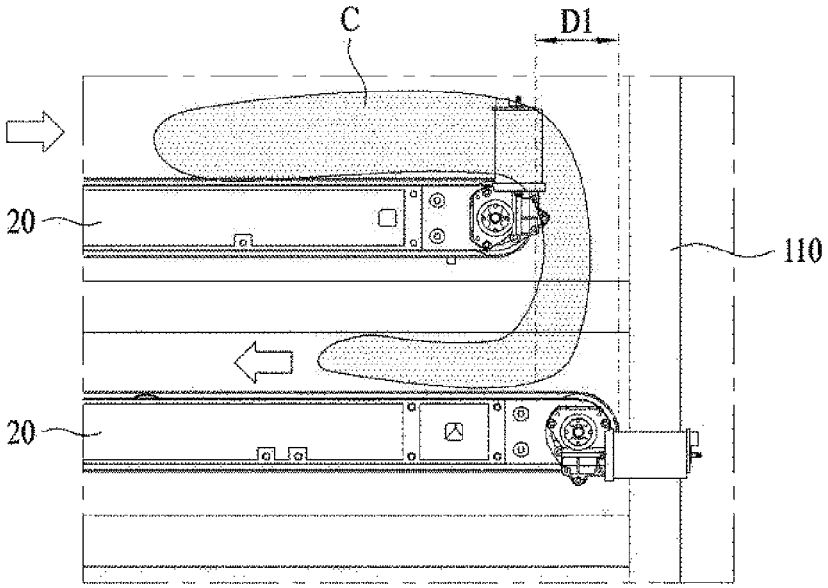
FIG. 4 is a partially enlarged side view illustrating a state in which a conveyor of the folding assembly in FIG. 3 is disposed.

In the present application, it will be appreciated that terms "including" and "having" are intended to designate the existence of characteristics, numbers, steps, operations, constituent elements, and components described in the specification or a combination thereof, and do not exclude a possibility of the existence or addition of one or more other characteristics, numbers, steps, operations, constituent elements, and components, or a combination thereof in advance. Hereinafter, a garment folding apparatus 10 according to the present disclosure will be described with reference to a description with reference to FIGS. 1 to 4. FIG. 1 is a perspective view of a garment folding apparatus according to an embodiment of the present disclosure, FIG. 2 is a side view of the garment folding apparatus in FIG. 1, FIG. 3 is a side view illustrating a configuration of a folding assembly according to the embodiment of the present disclosure, and FIG. 4 is a partially enlarged side view illustrating a state in which a conveyor of the folding assembly in FIG. 3 is disposed.

Referring to the drawings, the garment folding apparatus 10 according to the present disclosure may be supported and installed on a frame 110. The frame may serve as an external framework of the garment folding apparatus 10. The frame may be disposed on an outer edge of the garment folding apparatus 10 and define a minimum operating space for the garment folding apparatus 10. Several members constituting the garment folding apparatus 10 may be stably attached to and supported on the frame.

The frame includes an upper frame 111, a lower frame 112, and horizontal frames 113, 114, 115, 116, and 117.

The upper frame 111 may be horizontally disposed at an upper end of the garment folding apparatus 10. An upper operating space of the garment folding apparatus 10 may be defined by the upper frame 111.

The lower frame 112 may be horizontally disposed at a lower end of the garment folding apparatus 10. The lower frame 112 may support the garment folding apparatus 10 from a floor surface. A lower operating space of the garment folding apparatus 10 may be defined by the lower frame 112.

Two or more horizontal frames may be horizontally disposed between the upper frame 111 and the lower frame 112. A conveyor 20 (see FIG. 2) and a drive motor 30 (see FIG. 20), will be described below, may be mounted and supported on the horizontal frame.

A space between the two horizontal frames may be defined as an operating space for a folding layer to be described below. For example, an operating space of a second folding layer 220 (see FIG. 3) for performing a vertical folding process may be defined by the two horizontal frames 114 and 115.

In addition, the space between the two horizontal frames may be defined as operating spaces of at least two folding layers. For example, operating spaces for third and fourth folding layers 230 and 240 (see FIG. 3) for performing a horizontal folding process may be defined by the two horizontal frames 115 and 116.

In addition, an assembly for holding and conveying a garment loaded onto the loading unit 101 may be supported on an upper portion of the horizontal frame 113 disposed adjacent to the upper frame 111. A guide rail, which serves to allow a support conveyor 25 to be described below to slide in a forward/rearward direction, may be supported on a lower portion of the horizontal frame 117 disposed adjacent to the lower frame 112.

The frame includes vertical frames 121, 122, 123, and 124 (see FIG. 1) disposed vertically and configured to support the upper frame 111, the lower frame 112, and the horizontal frames.

The vertical frames include a front frame 121 disposed at a front side at which the garment is loaded, and a rear frame 122 disposed to be opposite to the front frame 121 and configured to define a rear operating space of the garment folding apparatus 10.

A finishing cover (not illustrated) may be stably attached to an outer peripheral surface of the frame. The finishing cover may define an external appearance of the garment folding apparatus.

Since the frame is provided as described above, the operating vertical folding assembly may be stably supported and mounted on the frame so that garment folding functions are smoothly performed in the respective folding layers to be described below. Further, the vertical folding assembly required for the operating spaces of the folding layers vertically disposed with respect to one horizontal frame is also supported on the frame, such that a required space may be reduced, and an overall volume of the garment folding apparatus may be reduced.

The garment folding apparatus 10 includes a loading assembly 100, a folding assembly 200, and an unloading assembly 300.

The loading assembly 100, the folding assembly 200, and the unloading assembly 300 may be supported on the frame. In addition, the loading assembly 100, the folding assembly 200, and the unloading assembly 300 may have operating spaces defined by the frame.

For example, an operating space of the loading assembly 100 may be defined by the upper frame 111 and the horizontal frame 114, and an operating space of the unloading assembly 300 may be defined by the horizontal frame 116 and the lower frame 112.

The loading assembly 100 is provided to load the garment. The loading assembly 100 may be provided such that the garment loaded onto the loading unit 101 may be placed on an upper surface of the conveyor 20. Specifically, the loading assembly 100 may be provided between the upper frame 111 and the horizontal frame 114 so that the garment loaded onto the loading unit 101 may be placed on the upper surface of the conveyor 20.

In this case, the garments not only mean upper garments or lower garments manufactured using natural fibers or synthetic fibers so as to be worn by persons, but also include all products such as towels or bedclothes that may be provided by being folded to have desired sizes and thicknesses by the garment folding apparatus.

In one embodiment, in the loading assembly 100, the garment loaded by the loading unit 101 is held by a clip unit 103 (see FIGS. 1 and 2). Thereafter, the clip unit 103 pulls the garment rearward by a predetermined distance and releases the garment so that the garment is placed on the upper surface of the conveyor 20. The conveyor 20 may be supported by the horizontal frame 114, and the clip unit 103 may be supported by the horizontal frame 113 horizontally disposed between the upper frame 111 and the horizontal frame 114.

The unloading assembly 300 serve to collect and unload the folded garments. The unloading assembly 300 may be configured such that the completely folded garments are conveyed from an unloading layer 310 (see FIG. 3) by the support conveyor and collected on an unloading unit 301. Specifically, the unloading assembly 300 may be provided between the horizontal frame 116 and the lower frame 112 so that the completely folded garments are conveyed by the support conveyor and collected on the unloading unit 301.

Figure 19:
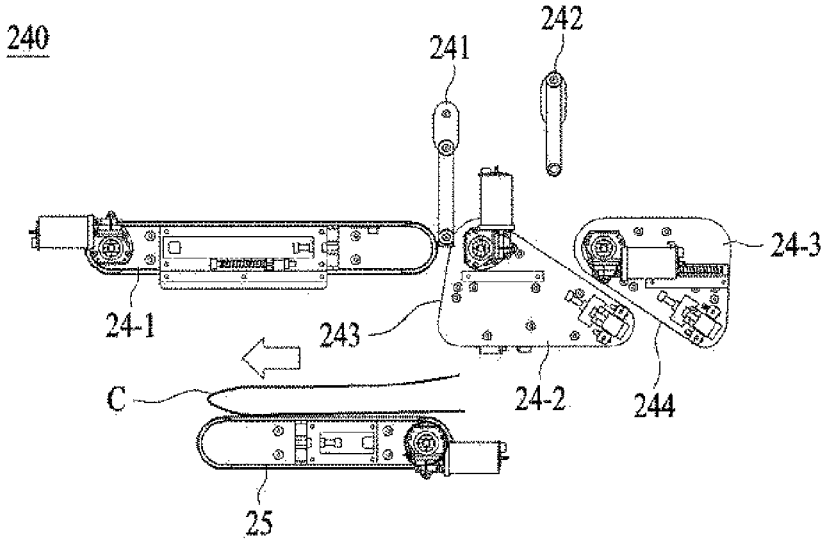
FIG. 19 is a view illustrating a state in which a garment having passed through the fourth folding layer according to the embodiment of the present disclosure is conveyed.

In one embodiment, the garment dropped by the folding assembly is placed on the support conveyor 25 (see FIG. 19). Thereafter, the support conveyor 25 moves in the forward/rearward direction, and at the same time, an unloading plate (not illustrated) moves in the upward/downward direction, such that the completely folded garments are uniformly collected in an internal space of the unloading unit 301. A guide rail configured to guide and support the movement of the support conveyor 25 may be supported by the horizontal frame 117 horizontally disposed between the horizontal frame 116 and the lower frame 112. The vertical movement of the unloading plate of the vertical folding assembly may be supported by the lower frame 112.

The folding assembly 200 serve to convey and fold the loaded garment. The folding assembly 200 includes the two or more folding layers so that the loaded garment is folded to an appropriate size and shape. The two or more folding layers are disposed to be vertically spaced apart from each other. The loaded garment is folded one or more times in the respective folding layers while being conveyed from the folding layer at the upper side to the folding layer at the lower side, and the garments, which are completely folded to appropriate sizes and shapes, are collected in a discharge unit 301.

In the embodiment illustrated in FIG. 3, the folding assembly 200 may include four folding layers 210, 220, 230, and 240. The four folding layers 210, 220, 230, and 240 may be disposed to be vertically spaced apart from each other and serve to allow the loaded garment to be folded to an appropriate size and shape while being conveyed from the first folding layer 210 at the upper side to the fourth folding layer 240 at the lower side. The garment is folded one or more times in each of the folding layers. For example, the garment may be folded twice in the fourth folding layer 240.

The unloading layer 310 may be disposed below the lowermost folding layer. In the embodiment illustrated in FIG. 3, the unloading layer 310 may be further provided below the fourth folding layer 240, and the completely folded garment is dropped onto the unloading layer 310. As described above, the unloading layer 310 has the unloading unit 301 on which the completely folded garments are uniformly collected.

The folding layer includes the conveyor 20. The conveyor 20 serves to horizontally convey the loaded or dropped garment. The folding layers each have one or more conveyors 20. In a case in which the single folding layer has the two or more conveyors, a folding gap through which the garment is folded or passes while being folded is provided between the two conveyors.

In the embodiment illustrated in FIG. 3, the four folding layers 210, 220, 230, and 240 may each have one or more conveyors 20. The third folding layer 230 may have the two conveyors 20, and the fourth folding layer 240 may have the three conveyors 20. A folding gap through which the garment may pass while being folded may be formed between the two conveyors disposed in the third folding layer 230. Two folding gaps through which the garment may be folded or pass while being folded may be formed between the three conveyors provided in the fourth folding layer 240.

The support conveyor 25 may be provided to be horizontally movable in the unloading layer 310. As described above, the support conveyor 25, together with the unloading plate (not illustrated), serves to uniformly collect the completely folded garments on the unloading unit 301.

Meanwhile, the folding assembly 200 may be configured such that the loaded garment is vertically folded while being conveyed, and the loaded or dropped garments is horizontal folded while being conveyed.

In the embodiment illustrated in FIG. 3, among the four folding layers constituting the folding assembly 200, the garment may be vertically folded in the two folding layers 210 and 220 (hereinafter, referred to as 'vertical folding layers') at the upper side, and the garment may be horizontally folded in the two folding layers 230 and 240 (hereinafter, referred to as 'horizontal folding layers') at the lower side.

In this case, the horizontal folding process means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

In this case, the vertical folding process means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

The structures and functions of the vertical folding layer and the horizontal folding layer will be described below in detail.

In the folding assembly 200, the plurality of conveyors 20 may be disposed in a zigzag manner. That is, in the folding assembly 200, the conveyors constituting the vertically disposed folding layers may be disposed in a staggered manner in the horizontal direction. Since the conveyors are disposed in a zigzag manner, a space in which the garment dropped from the upper container may be received directly by the lower container is ensured.

In the embodiment illustrated in FIG. 4, the conveyor 20 constituting the upper folding layer and the conveyor 20 constituting the lower folding layer may be disposed in a staggered manner in the horizontal direction. Therefore, a space D1 in which the garment C dropped from the upper conveyor 20 may be loaded directly onto the lower conveyor 20 is ensured.

As described above, since the upper and lower conveyors are disposed in a zigzag manner, it is possible to prevent interruption that often occurs at a portion where the garment switches from the upper conveyor to the lower conveyor. For example, when a separate space or device for switching from the upper conveyor to the lower conveyor is provided, the garments may be stacked vertically, which may adversely affect the conveyance efficiency of the garment folding apparatus. However, according to the present embodiment, the upper conveyor and the lower conveyor are disposed in a staggered manner in the horizontal direction and ensure the loading space D1, thereby simply and completely coping with the bottleneck situation.

In addition, since the upper and lower conveyors are disposed in a zigzag manner, the garment conveyance or workspace, which is out of the range of the frame, is not necessary. For example, unlike the embodiment illustrated in FIG. 4, if an end of the upper conveyor 20 is disposed at a position identical, in the horizontal direction, to the position of the lower conveyor 20, a space in which the dropped garment is loaded while deviating rightward from the frame needs to be provided, and a separate device for transferring the garment to the lower conveyor 20 needs to be provided. The configuration according to the present embodiment in which the upper and lower conveyors are disposed in a staggered manner in the horizontal direction may be substituted for the additional space and device functions, thereby contributing to reductions in costs and sizes.

In addition to the arrangement of the conveyors in a zigzag manner, the folding assembly 200 has sensor units 40 (see FIG. 22), such that the garment may be normally and efficiently dropped and loaded. For example, referring to FIG. 4, the upper and lower conveyors are disposed in a staggered manner in the horizontal direction with the predetermined loading space D1 interposed therebetween, a garment detection sensor protruding downward from the upper conveyor may be provided to immediately detect normal loading or a bottleneck situation of the garment dropped through the loading space D1. In addition, a garment detection sensor may also be provided on an upper portion of the lower conveyor so as to emit a detection signal toward the loading space D1 from the lower conveyor. The general arrangement and functions of the sensor units 40 will be described below in detail.

Hereinafter, the respective folding layers constituting the folding assembly will be specifically described with reference to FIGS. 5 to 19. FIGS. 5 to 12 illustrate the configuration of the vertical folding layer, and FIGS. 13 to 19 illustrate the configuration of the horizontal folding layer.

Figure 5:
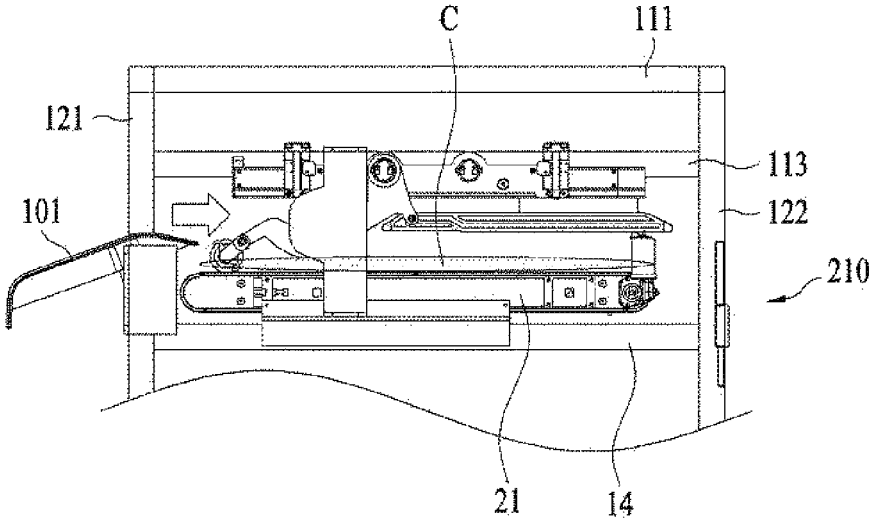
FIG. 5 is a side view illustrating a first folding layer according to the embodiment of the present disclosure.
Figure 6:
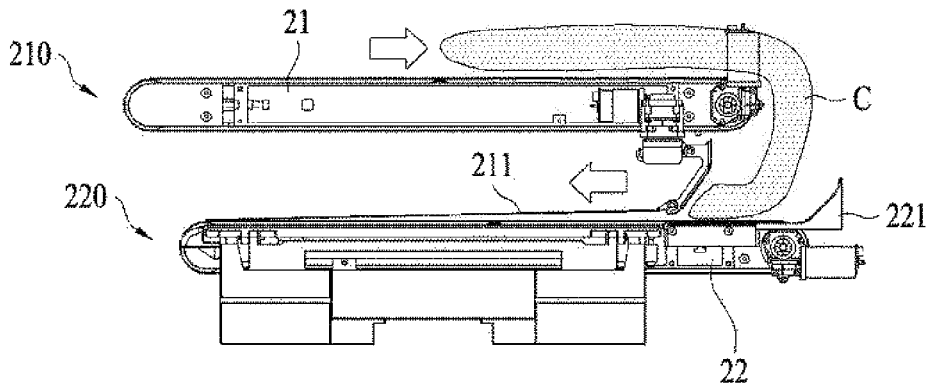
FIG. 6 is a side view illustrating the first folding layer and a second folding layer according to the embodiment of the present disclosure.
Figure 7:
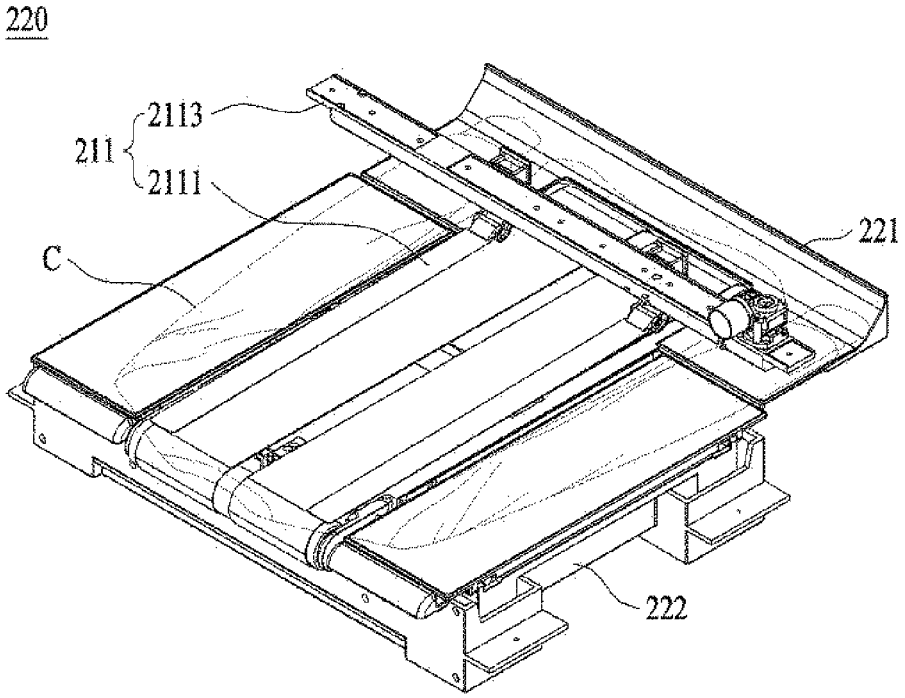
FIG. 7 is a perspective view illustrating an operation of a vertical folding assembly according to the embodiment of the present disclosure before the vertical folding assembly performs a folding operation.
Figure 8:
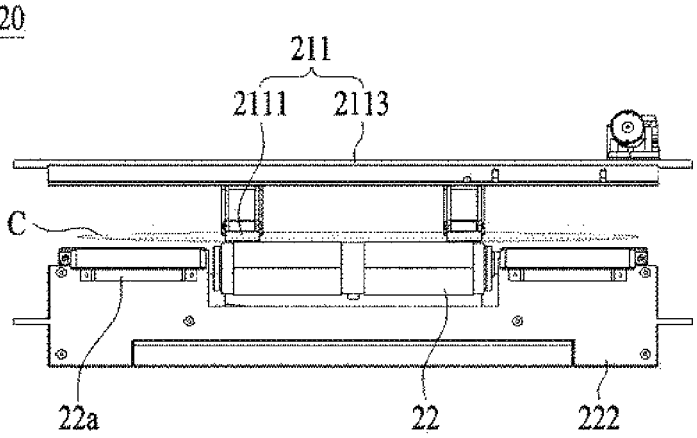
FIG. 8 is a front view of FIG. 7.
Figure 9:
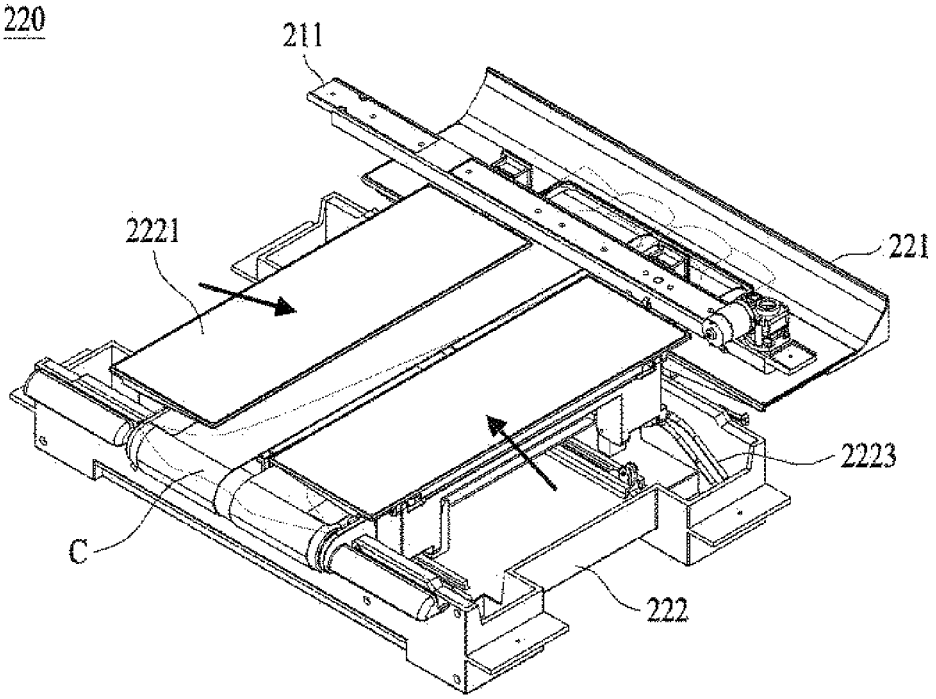
FIG. 9 is a perspective view illustrating an operation of the vertical folding assembly according to the embodiment of the present disclosure after the vertical folding assembly performs the folding operation.
Figure 10:
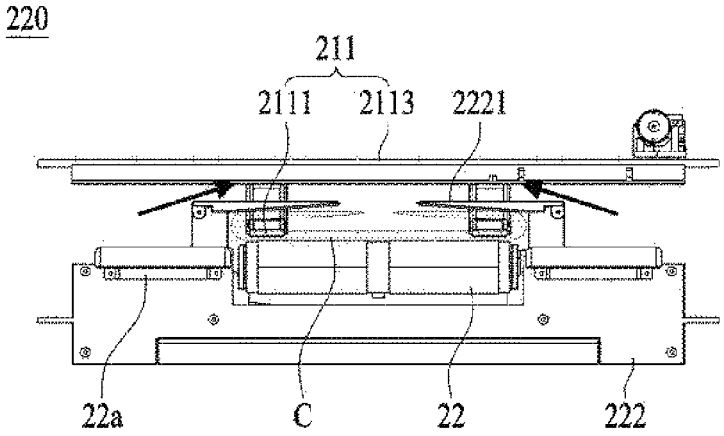
FIG. 10 is a front view of FIG. 9.
Figure 11:
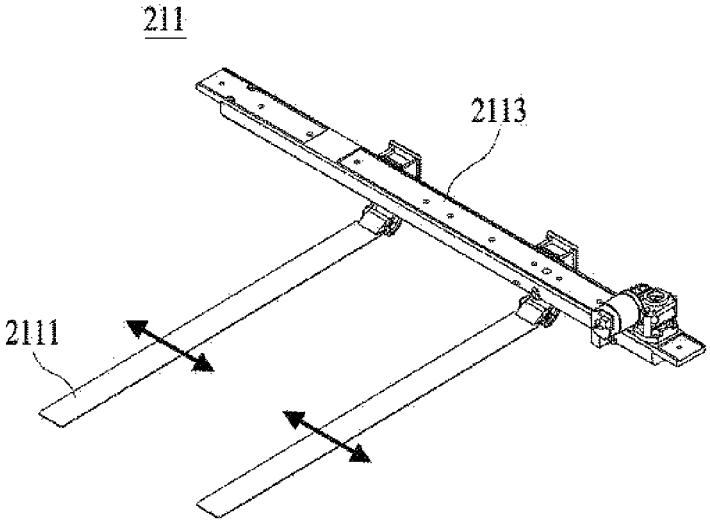
FIG. 11 is a perspective view of a vertical folding guide unit constituting the vertical folding assembly according to the embodiment of the present disclosure.
Figure 12:
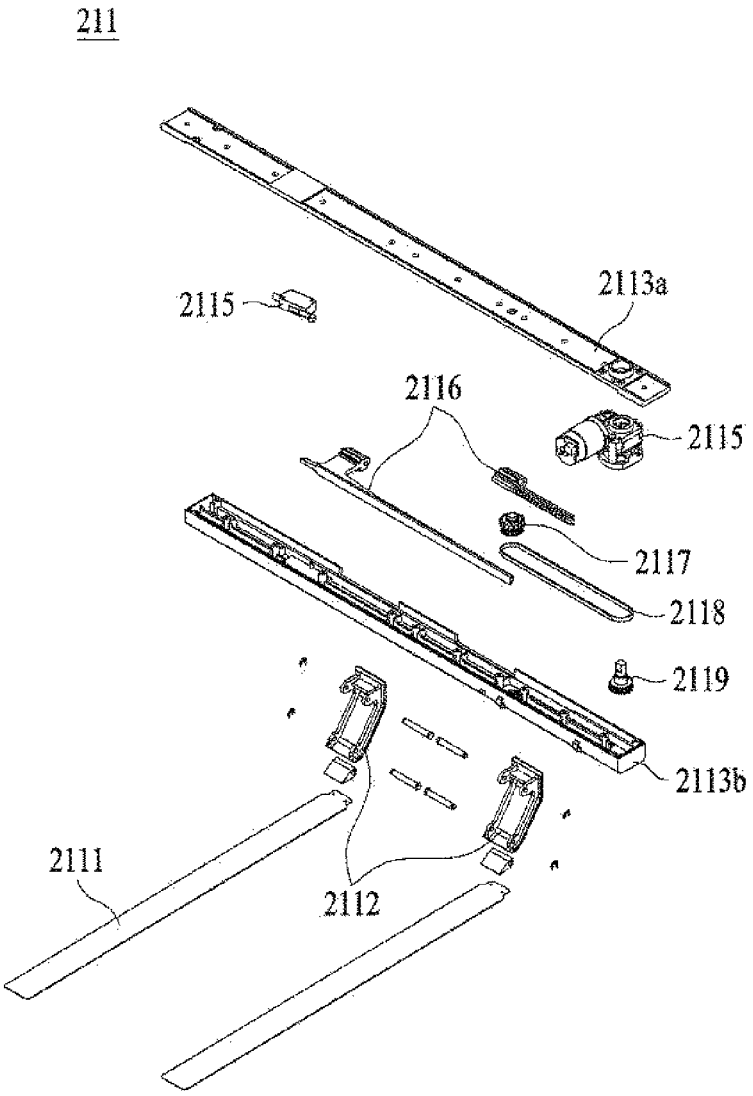
FIG. 12 is an exploded perspective view of the vertical folding guide unit in FIG. 11.

Specifically, FIG. 5 is a side view illustrating the first folding layer according to the embodiment of the present disclosure, FIG. 6 is a side view illustrating the first folding layer and the second folding layer according to the embodiment of the present disclosure, FIG. 7 is a perspective view illustrating an operation of the vertical folding assembly according to the embodiment of the present disclosure before the vertical folding assembly performs a folding operation, FIG. 8 is a front view of FIG. 7, FIG. 9 is a perspective view illustrating an operation of the vertical folding assembly according to the embodiment of the present disclosure after the vertical folding assembly performs the folding operation, FIG. 10 is a front view of FIG. 9, FIG. 11 is a perspective view of a vertical folding guide unit constituting the vertical folding assembly according to the embodiment of the present disclosure, and FIG. 12 is an exploded perspective view of the vertical folding guide unit in FIG. 11.

Referring to the drawings, the folding assembly 200 includes the vertical folding layer that serves to vertically fold the loaded garment. The folding assembly 200 may include the first folding layer 210.

The first folding layer 210 may be configured to vertically fold the garment loaded from the loading assembly 100 while conveying the garment to a rear end thereof.

Specifically, the first folding layer 210 may include a conveyor 21 on which the garment loaded by the loading unit 101 of the loading assembly 100 is placed by being pulled by the clip unit 103 (see FIGS. 1 and 2). The conveyor 21 conveys the placed garment C to the rear end.

Further, the vertical folding assembly (not illustrated) may be provided to vertically fold the conveying garment C. The vertical folding assembly (not illustrated) may be configured as a passive vertical folding assembly that allows the garment to be naturally folded while being conveyed instead of being configured as an active folding mechanism that is folded by receiving a force of a drive motor. For example, folder units (not illustrated) may protrude from two opposite sides of the conveyor 21 so that sleeve portions of the garment are folded inward while the garment is conveyed.

As described above, the first folding layer 210 is configured such that the garment may be loaded and folded in the same horizontal space. The loading by the loading assembly 100 and the vertical folding process are simultaneously performed in the same layer, which may contribute to the simplification of the folding process and the reduction in size of the apparatus.

Meanwhile, the garment detection sensor may be provided at an upper rear side of the conveyor 21. The garment detection sensor may recognize whether the garment C is normally loaded onto the conveyor 21 or detect an overall length of the garment C. The general arrangement and functions of the garment detection sensor will be described below in detail.

The folding assembly 200 may include the second folding layer 220. The vertical folding layer may include the first folding layer 210 and the second folding layer 220.

The second folding layer 220 may be provided below the first folding layer 210. The second folding layer 220 may be configured to vertically fold the garment loaded from the first folding layer 210 while conveying the garment forward.

The garment loaded from the loading assembly 100 may be subjected to the intended vertical folding process while passing through the vertical folding layer including the first folding layer 210 and the second folding layer 220. In other words, the folding assembly 200 may have the vertical folding layer that serves to vertically fold the loaded garment to an intended size and shape.

The vertical folding layer may have a vertical folding guide unit 211. In the embodiment illustrated in FIG. 6, the vertical folding guide unit 211 may be mounted on the conveyor 21 of the first folding layer 210. The vertical folding guide unit 211 may be supported on a lower portion of the conveyor 21 of the first folding layer 210 and stably guide the garment C conveyed forward from the second folding layer 220 by pushing the garment C downward. The outer portion of the garment C guided by the vertical folding guide unit 211 is folded inward by a vertical folding assembly 222.

Referring to FIG. 11, the vertical folding guide unit 211 includes guide blades 2111 and a guide frame 2113.

The guide blade 2111 has a flat shape elongated forward and pushes the conveyed garment C downward while providing a vertical folding reference line. The guide blade 2111 is inclined downward in the forward direction, such that the conveyed garment C may be stably deployed while being gradually pushed.

The guide frame 2113 is mounted on the conveyor 21 and serves to support the guide blades 2111. The guide frame 2113 may be elongated in a width direction (the arrow direction in FIG. 11) perpendicular to the guide blade 2111.

In the embodiment illustrated in FIG. 6, the vertical folding guide unit 211 may be mounted on the upper conveyor and stably guide the garment loaded onto the lower conveyor by pushing the garment downward. The guide frame 2113 of the vertical folding guide unit 211 may be mounted on the upper conveyor and support the guide blade 2111 in order to guide the garment loaded onto the upper surface of the lower conveyor. To more stably guide the garment, the guide blade 2111 may be inclined downward in the forward direction from the upper surface of the lower conveyor.

The positions of the guide blades 2111 may be changed in the width direction relative to the guide frame 2113. In the embodiment illustrated in FIG. 12, the vertical folding guide unit 211 may include a rack 2116 and a pinion 2117 in order to ensure changeability of the guide blades 2111. Specifically, an external appearance of the guide frame 2113 is defined by an upper frame body 2113*a* and a lower frame body 2113*b*. The pinion 2117 is disposed in the guide frame 2113 and connected to a motor gear 2119 through a belt 2118, and receives a rotational force of the motor gear 2119. The rack 2116 is disposed in the width direction and engages with the pinion 2117. A microswitch 2115 may be provided to detect and control the operations of the rack and the pinion.

Since the positions of the guide blades 2111 are changed in the width direction as described above, the guide blades 2111 may treat the garments having various sizes and shapes, thereby performing the intended accurate vertical folding process. For example, when the vertical folding process is intended to fold the garment having a large width into a small width, the guide blades 2111 may be moved inward to implement the desired vertical folding process without particular hindrance.

Two or more guide blades 2111 may be provided on the guide frame 2113. The two guide blades 2111 may be provided on the guide frame 2113 at a predetermined interval so that the two opposite outer portions of the garment C may be symmetrically folded inward. As described above, the two guide blades 2111 may change in positions in the width direction in consideration of the size and shape of the garment C which is an object to be vertically folded.

In addition, the vertical folding guide unit 211 may include links 2112. Specifically, the link 2112 may serve to mediate the guide blade 2111 and the guide frame 2113. That is, one end of the link 2112 may be hingedly coupled to the guide blade 2111, and the other end of the link 2112 may be hingedly coupled to the guide frame 2113.

In addition, in the embodiment illustrated in FIG. 6, the link 2112 may serve to mediate the guide frame 2113 mounted on the upper conveyor and the guide blade 2111 capable of guiding the garment loaded onto the upper surface of the lower conveyor. To more stably guide the garment, the link 2112 may be inclined downward in the forward direction. A value of the inclination of the link 2112 is larger than a value of the inclination of the guide blade 2111, such that the dropped and loaded garment is gradually deployed forward.

As described above, the hinge-type operation of the guide blade 2111 is implemented by the link 2112, such that the vertical folding guide function may be stably performed to treat the garments having various thicknesses. For example, in the embodiment illustrated in FIG. 6, when a thick garment passes through a lower side of the guide blade 2111, the link 2112 finely rotates in the conveyance direction (clockwise based on FIG. 6), such that an interval is ensured between the guide blade 2111 and the conveyor 22, and the garment is stably guided without particular hindrance.

Meanwhile, the vertical folding layer may include a conveyance guide unit 221. In the embodiment illustrated in FIG. 6, the conveyance guide unit 221 may be provided on the conveyor 22 of the second folding layer 220. As described above, the two conveyors are disposed in a zigzag manner so that the garment C dropped from the conveyor 21 of the first folding layer 210 is placed directly onto the conveyor 22 of the second folding layer 220. Further, the conveyance guide unit 221 is provided on the lower conveyor 22, such that the separation of the dropped garment C may be prevented, and the garment may be stably conveyed to the lower conveyor 22. Of course, as described above, the conveyance guide unit 221 may be provided so as not to deviate from the range of the frame in order to prevent unnecessary expansion of the workspace.

The conveyance guide unit 221 may be provided in the horizontal folding layer in order to contribute to stable conveyance between the upper and lower conveyors. For example, the conveyance guide unit 221 may also be provided on the conveyors of the third folding layer 230 and the fourth folding layer 240 so that the dropped garment may stably change in horizontal directions.

Meanwhile, the vertical folding layer may include the vertical folding assembly 222. The vertical folding assembly 222 means an active vertical folding assembly that may be changed in position by the drive motor so that the garment deployed on the conveyor is vertically folded. Referring to the embodiment illustrated in FIG. 10, the vertical folding assembly 222 operates plates 2221 by using the drive motor or the like so that the two opposite outer portions of the garment C placed on an auxiliary conveyor 22*a* are folded with respect to the guide blades 2111. In this case, the plates 2221 may move inward along guide grooves formed in vertical folding support pieces 2223 (see FIG. 9). The plates 2221 may be changed in positions to fold the garment.

In some instances, the vertical folding layer may immediately convey the garment to the lower folding layer without performing the vertical folding process. Specifically, the garment loaded to the second folding layer 220 may be conveyed forward by the conveyor 22 and loaded to the third folding layer 230 disposed below the second folding layer 220 without being vertically folded by the vertical folding assembly 222. As described above, the vertical folding process, which conforms to the garments having various sizes and shapes, may be implemented. Meanwhile, the garment detection sensors may be provided at upper front and rear sides of the conveyor 22 provided in the second folding layer 220. The general arrangement and functions of the garment detection sensor will be described below in detail.

Figure 13:
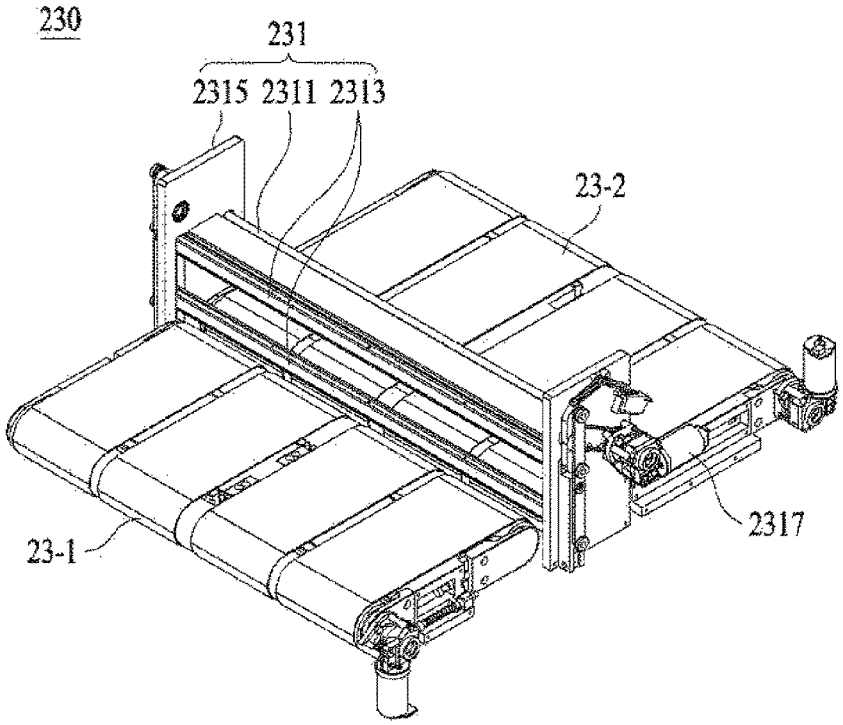
FIG. 13 is a perspective view illustrating a third folding layer according to the embodiment of the present disclosure.
Figure 14:
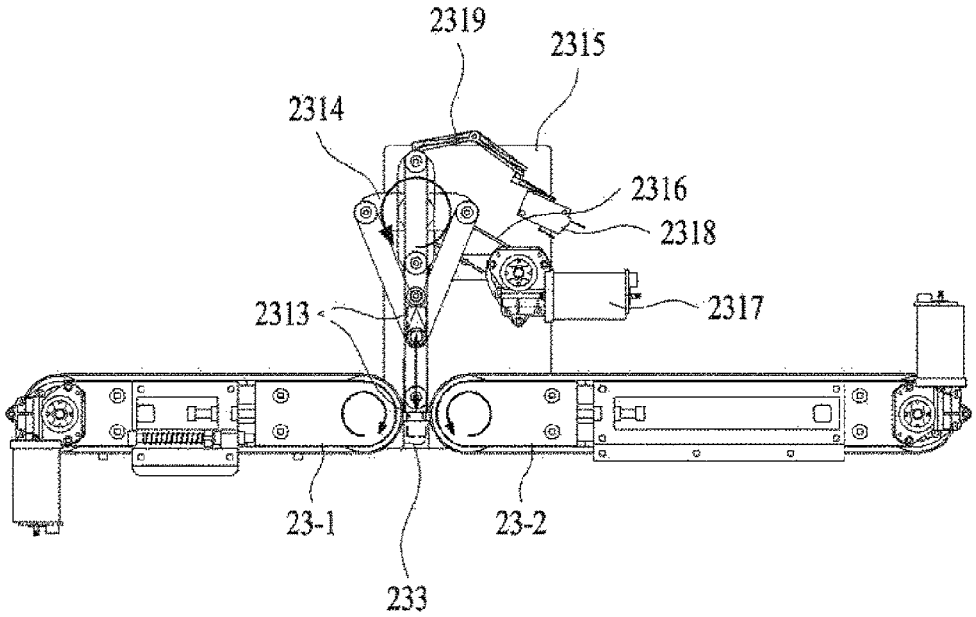
FIG. 14 is a detailed side view of the third folding layer according to the embodiment of the present disclosure.
Figure 15:
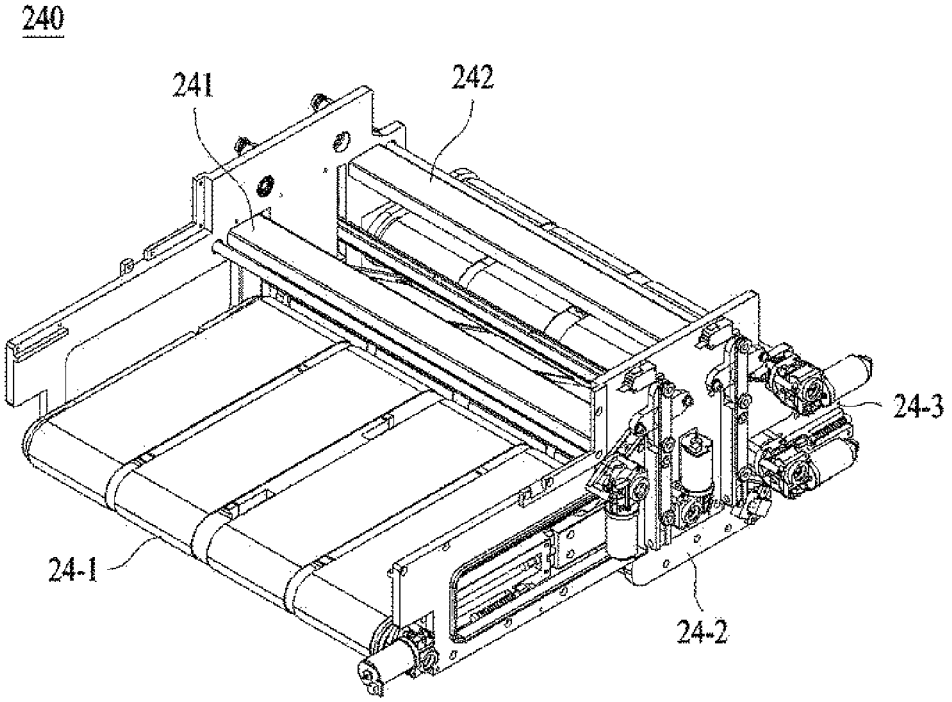
FIG. 15 is a perspective view illustrating a fourth folding layer according to the embodiment of the present disclosure.
Figure 16:
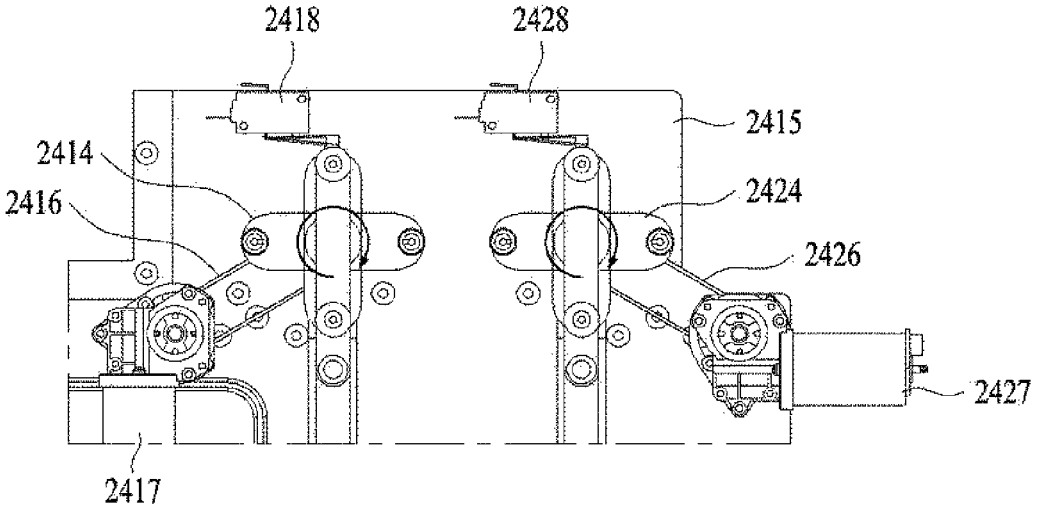
FIG. 16 is a detailed side view of the fourth folding layer according to the embodiment of the present disclosure.
Figure 17:
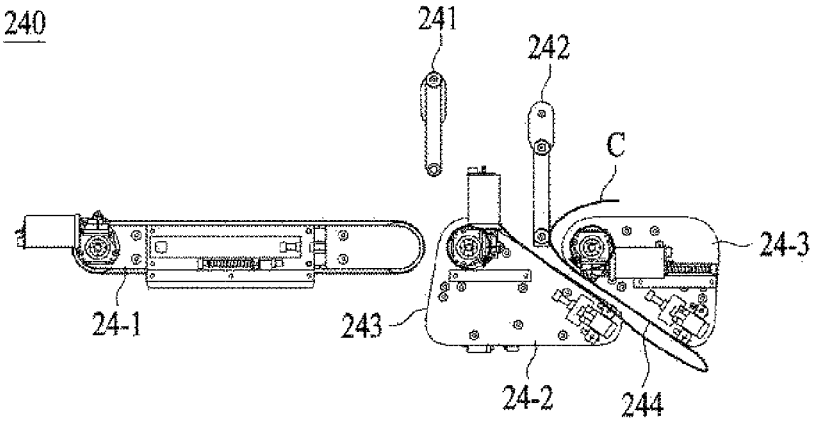
FIG. 17 is a view illustrating one embodiment of a horizontal folding process performed in the fourth folding layer.
Figure 18:
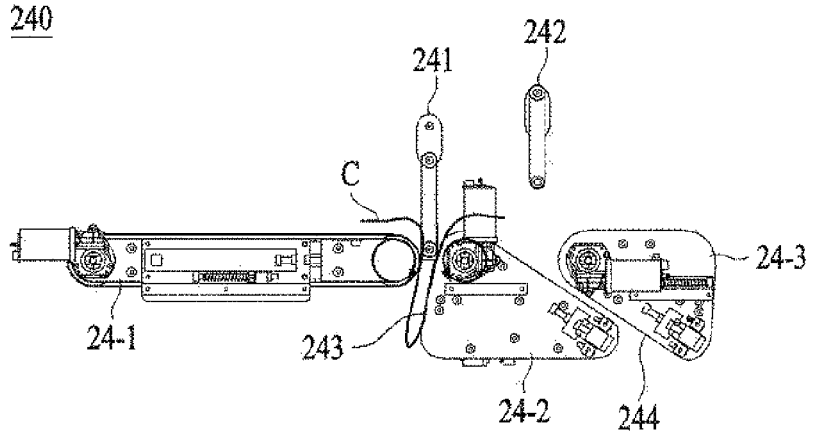
FIG. 18 is a view illustrating another embodiment of the horizontal folding process performed in the fourth folding layer.

FIGS. 13 to 19 are views illustrating the configuration of the horizontal folding layer, in which FIG. 13 is a perspective view illustrating the third folding layer according to the present disclosure, FIG. 14 is a detailed side view of the third folding layer, FIG. 15 is a perspective view illustrating the fourth folding layer, FIG. 16 is a detailed side view of the fourth folding layer, FIG. 17 is a view illustrating a horizontal folding process performed by the fourth folding layer, FIG. 18 is a view illustrating another horizontal folding process performed by the fourth folding layer, and FIG. 19 is a view illustrating a state in which a garment having passed through the fourth folding layer is conveyed.

Referring to the drawings, the folding assembly 200 includes the horizontal folding layer that serves to horizontally fold the loaded garment. In the folding assembly 200, the horizontal folding layer may be disposed below the vertical folding layer. The folding assembly 200 may include the third folding layer 230.

The third folding layer 230 may be configured to horizontally fold the loaded garment while conveying the garment rearward. The third folding layer 230 may be disposed below the second folding layer 220 that performs the vertical folding process.

The third folding layer 230 may be disposed immediately below the second folding layer 220 so that the completely folded garment is directly loaded from the second folding layer 220. Therefore, the vertical operating space between the folding layers is reduced, which may contribute to a reduction in size of the folding apparatus.

Specifically, the third folding layer 230 includes a conveyor 23 configured to convey the loaded garment rearward or convey the garment so that the garment positioned at an intermediate position is withdrawn to a folding gap 233 (see FIG. 14).

The conveyor 23 may include a front conveyor 23-1 and a rear conveyor 23-2. The front conveyor 23-1 serves to load the dropped or loaded garment and convey the garment rearward. The rear conveyor 23-2 is disposed in the same horizontal space as the front conveyor 23-1. The rear conveyor 23-2 operates in a direction opposite to the rotation direction of the front conveyor 23-1 in order to continuously convey, rearward, the garment received from the front conveyor 23-1 or withdraw the garment to the folding gap 233 (see the rotation of the rear conveyor indicated by the arrow in FIG. 14).

Since the front conveyor 23-1 and the rear conveyor 23-2 are provided as described above, it is possible to quickly horizontally fold the garment while deploying the loaded garment. In some instances, the horizontal folding process may be eliminated, and the garment may be conveyed to the fourth folding layer 240 disposed below the third folding layer 230, such that the horizontal folding process, which conforms to the garments having various sizes and shapes, may be implemented. The process of loading the garment, the process of horizontally folding the garment by using the horizontal folding assembly 231, and the process of conveying the garment to the lower folding layer are performed in the same horizontal space. Therefore, it is possible to contribute to the simplification of the folding process and the reduction in size of the apparatus.

In the embodiment illustrated in FIG. 13, the horizontal folding layer includes the horizontal folding assembly 231. The horizontal folding assembly 231 may include a sink bar 2311, a folding bar 2313, support pieces 2315, and a drive motor 2317 so as to horizontally fold the garment C while simultaneously withdrawing the garment C through the folding gap 233.

Referring to FIG. 14, a rotational force of the drive motor 2317 connected to a timing belt 2316 is transmitted to connecting rods 2314 supported on the support pieces 2315. The support pieces 2315 may be provided at left and right sides of the conveyor 23. The sink bar 2311 has two opposite ends coupled to the left and right connecting rods 2314 so that the operations of the left and right connecting rods 2314 are synchronized. When the connecting rods 2314 rotate, one end of a link bar connected to the connecting rod 2314 slides leftward and rightward, and the upward and downward movements of the folding bar 2313 connected to the other end of the link bar are implemented (see the arrow in the upward/downward direction in FIG. 14).

A microswitch 2318 is provided adjacent to the connecting rod 2314 and detects a position of an upper end of the folding bar 2313, such that the on-off control of the drive motor 2317 may be implemented. A lever 2319 may be provided on the support piece 2315 to ensure a spacing distance of the microswitch 2318.

As described above, the garment C may be horizontally folded by the horizontal folding assembly 231 and the two conveyors 23-1 and 23-2. The garment C may be withdrawn downward through the folding gap 233 by the folding bar 2313 of the horizontal folding assembly 231. In this case, the two conveyors 23-1 and 23-2 rotate in the opposite directions, such that the garment C is folded at the folding gap 233, and simultaneously the garment C is pulled downward and dropped. The two conveyors 23-1 and 23-2 may simultaneously rotate in the opposite directions.

Meanwhile, the conveyor 23 may have a detection sensor. The detection sensor may accurately recognize a horizontally folded portion of the garment C, such that the garment C may be positioned in the folding gap 233 between the two conveyors 23-1 and 23-2.

The garment detection sensor provided at a lower end of the conveyor 23 may detect the garment C passing through the folding gap 233, thereby recognizing whether the garment C has been normally folded horizontally or whether the garment is jammed. The general arrangement and functions of the garment detection sensor will be described below in detail.

The folding assembly 200 may include the fourth folding layer 240. The horizontal folding layer may include the third folding layer 230 and the fourth folding layer 240.

The fourth folding layer 240 may be provided below the third folding layer 230. The fourth folding layer 240 may be configured to horizontally fold the garment loaded from the third folding layer 230 while conveying the garment.

The fourth folding layer 240 may be disposed immediately below the third folding layer 230 so that the completely folded garment is directly loaded from the third folding layer 230. Therefore, the vertical operating space between the folding layers is reduced, which may contribute to a reduction in size of the folding apparatus.

The garment loaded from the vertical folding layer may be subjected to the intended horizontal folding process while passing through the horizontal folding layer including the third folding layer 230 and the fourth folding layer 240. That is, the folding assembly 200 may have the horizontal folding layer that serves to horizontally fold the loaded garment to an intended size and shape.

Specifically, the fourth folding layer 240 may include a conveyor 24 configured to convey the loaded garment forward or convey the garment so that the garment positioned at the intermediate position is withdrawn to folding gaps 243 and 244 (see FIG. 17).

The conveyor 24 may include a front conveyor 24-1, an intermediate conveyor 24-2, and a rear conveyor 24-2. The front conveyor 24-1 or the rear conveyor 24-3 serves to load the dropped or loaded garment and convey the garment rearward or forward. The garment dropped from the third folding layer 230 through the folding gap 233 is loaded to the front conveyor 24-1, and the garment dropped by being conveyed by the rear conveyor 23-2 of the third folding layer 230 may be loaded to the rear conveyor 24-3.

Referring to FIG. 17, the intermediate conveyor 24-2 is disposed in the same horizontal space as the rear conveyor 24-3 and spaced apart from the rear conveyor 24-3 in the horizontal direction, thereby defining a folding gap 244. The intermediate conveyor 24-2 operates in a direction opposite to the rotation direction of the rear conveyor 24-3 (see the rotation of the intermediate conveyor indicated by the arrow in FIG. 17) so that the garment deployed on the rear conveyor 24-3 or the garment conveyed from the front conveyor 24-1 is folded through the folding gap 244.

The horizontal folding process may be performed, at a ⅓ point based on the conveyance direction, on the garment C through the folding gap 244 between the intermediate conveyor 24-2 and the rear conveyor 24-3 and then the garment may be pulled upward again. In this case, the intermediate conveyor 24-2 and the rear conveyor 24-3 are rotated in the reverse direction, such that the garment C may be disposed again on the upper surface of the conveyor 24.

Referring to FIG. 18, the intermediate conveyor 24-2 is disposed in the same horizontal space as the front conveyor 24-1 and spaced apart from the front conveyor 24-1 in the horizontal direction, thereby defining the folding gap 243. The intermediate conveyor 24-2 operates in a direction opposite to the rotation direction of the front conveyor 24-1 (see the rotation of the intermediate conveyor indicated by the arrow in FIG. 18) so that the garment deployed on the front conveyor 24-1 or the garment conveyed from the rear conveyor 24-3 is folded through the folding gap 243.

The horizontal folding process may be performed, at a ½ point based on the conveyance direction, on the garment C through the folding gap 243 between the intermediate conveyor 24-2 and the front conveyor 24-1, and then the garment C may be withdrawn downward. The garment withdrawn downward is conveyed to the unloading layer 310 (see FIG. 3). Specifically, the completely horizontally folded garment may be pulled downward through the folding gap 243 and loaded by the support conveyor 25 disposed below the conveyor 24 (see FIG. 19). The support conveyor 25, together with the unloading plate (not illustrated), stacks the completely folded garments and unloads the garments through the unloading unit 301.

Since the front conveyor 24-1, the intermediate conveyor 24-2, and the rear conveyor 24-2 are provided as described above, it is possible to quickly perform various horizontal folding processes while deploying the loaded garment. The two horizontal folding processes may be selectively or sequentially performed and conveyed to the unloading layer 310 at the lower side, such that the horizontal folding process, which conforms to the garments having various sizes and shapes, may be implemented. The process of loading the garment and the process of performing various horizontal folding processes by using two horizontal folding assemblies 241 and 242 are performed in the same horizontal space. Therefore, it is possible to contribute to the simplification of the folding process and the reduction in size of the apparatus.

In the embodiment illustrated in FIG. 15, the horizontal folding layer includes the horizontal folding assemblies 241 and 242. The horizontal folding assemblies 241 and 242 may include sink bars, folding bars, support pieces 2415, and drive motors 2417 and 2427 so as to horizontally fold the garment C through the folding gaps 243 and 244 while withdrawing the garment C simultaneously.

Specifically, the fourth folding layer 240 may have the two folding gaps 243 and 244. The horizontal folding assemblies may be provided to respectively correspond to the folding gaps so that the folding bars are independently controlled. That is, the folding bar and the assembly configured to move the folding bar upward or downward may be independently provided on the conveyor 24. To simplify the structure, the support pieces 2415 may be integrated and shared by the adjacent horizontal folding assemblies 241 and 242. Hereinafter, the horizontal folding assembly 241 corresponding to the folding gap 243 between the front conveyor 24-1 and the intermediate conveyor 24-2 may be more specifically described.

Referring to FIG. 16, a rotational force of the drive motor 2417 connected to a timing belt 2416 is transmitted to connecting rods 2414 supported on the support pieces 2415. The support pieces 2415 may be provided at left and right sides of the conveyor 24. The sink bar has two opposite ends coupled to the left and right connecting rods 2414 so that the operations of the left and right connecting rods 2414 are synchronized. When the connecting rods 2414 rotate, one end of a link bar connected to the connecting rod 2414 slides leftward and rightward, and the upward and downward movements of the folding bar connected to the other end of the link bar are implemented.

A microswitch 2418 is provided adjacent to the connecting rod 2414 and detects a position of an upper end of the folding bar, such that the on-off control of the drive motor 2417 may be implemented. A lever may be provided on the support piece 2315 to ensure a spacing distance of the microswitch 2418.

As described above, the garment C may be horizontally folded by the horizontal folding assemblies 241 and 242 and the conveyors 24-1, 24-2, and 24-3. The garment C may be withdrawn downward through the folding gaps 243 and 244 by folding bars 2413 and 2423 of the horizontal folding assemblies 241 and 242. In this case, the front conveyor 24-1 and the intermediate conveyor 24-2 rotate in the opposite directions or the intermediate conveyor 24-2 and the rear conveyor 24-3 rotate in the opposite directions, the garment C is folded at the folding gaps 243 and 244 or the garment C is pulled downward and dropped at the same time as the garment C is folded. The front conveyor 24-1 and the intermediate conveyor 24-2 may simultaneously rotate in the opposite directions, or the intermediate conveyor 24-2 and the rear conveyor 24-3 may simultaneously rotate in the opposite directions. The intermediate conveyor 24-2 and the rear conveyor 24-3 may rotate in the reverse direction to pull the garment upward.

Meanwhile, the conveyor 24 may have a detection sensor. The detection sensor may accurately recognize a horizontally folded portion of the garment C, such that the garment C may be positioned in the folding gaps 243 and 244.

The garment detection sensor provided at a lower end of the conveyor 24 may detect the garment C passing through the folding gaps 243 and 244, thereby recognizing whether the garment C has been normally folded horizontally or whether the garment is jammed. The general arrangement and functions of the garment detection sensor will be described below in detail.

Figure 20:
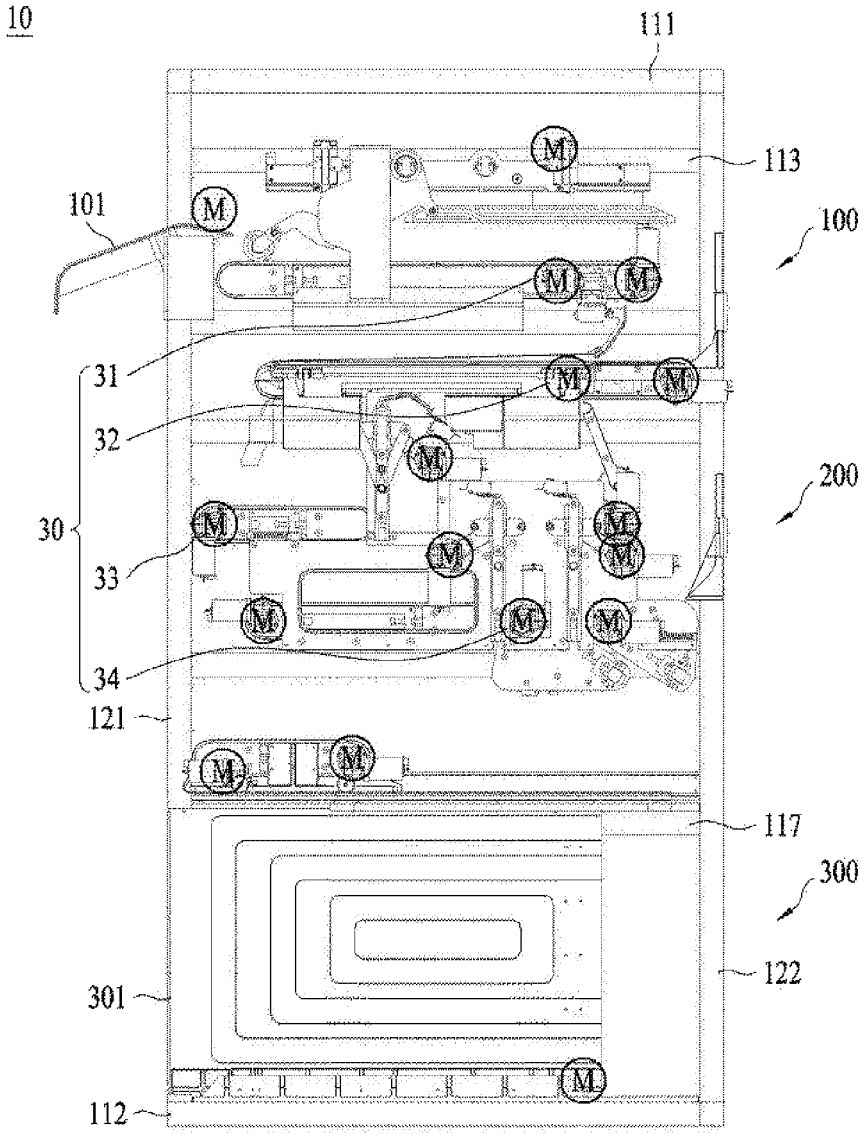
FIG. 20 is a side view illustrating a state in which drive motors according to the embodiment of the present disclosure are disposed.
Figure 21:
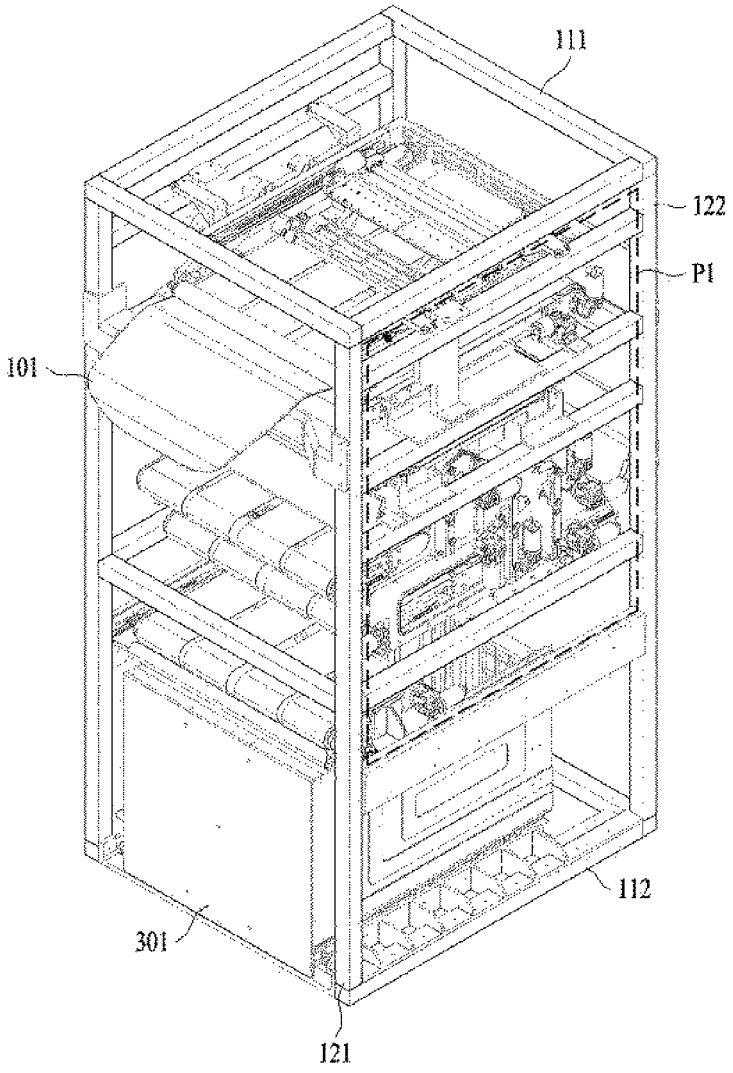
FIG. 21 is a perspective view illustrating a state in which the drive motors according to the embodiment of the present disclosure are disposed.

FIGS. 20 to 21 are views illustrating the drive motor disposed in the garment folding apparatus according to the present disclosure, in which FIG. 20 is a side view illustrating a state in which the drive motor according to the present disclosure is disposed, and FIG. 21 is a perspective view illustrating a state in which the drive motor according to the present disclosure is disposed.

The drive motor unit 30 includes a plurality of drive motors configured to provide rotational forces for operating the loading assembly 100, the folding assembly 200, and the unloading assembly 300. The plurality of drive motors 31, 32, 33, and 34 is provided to operate the conveyor 20, the vertical folding assembly, and the horizontal folding assembly that constitute the folding assembly 200.

Referring to FIGS. 20 and 21, the drive motor unit 30 may be provided at one side P1 of the garment folding apparatus 10. The plurality of drive motors constituting the drive motor unit 30 is provided within a range defined by the upper frame 111, the lower frame 112, the front frame 121, and the rear frame 122 that constitute one side of the garment folding apparatus 10. Specifically, the plurality of drive motors 31, 32, 33, and 34 constituting the folding assembly 200 may be provided within a vertical range of the two horizontal frames 113 and 117.

The drive motor unit 30 is concentrated on one side of the garment folding apparatus 10 or the folding assembly 200 as described above, which makes it easy to perform maintenance and heat dissipation. Specifically, the drive motor unit 30 is integrated on one side. Therefore, a door may be separably provided on a finishing cover (not illustrated), such that a manager may easily check the inside of the finishing cover and replace the drive motor or the like, as necessary. In addition, since the drive motor unit 30 is integrated on one side, heat dissipation required for the plurality of drive motors may be efficiently treated.

Figure 22:
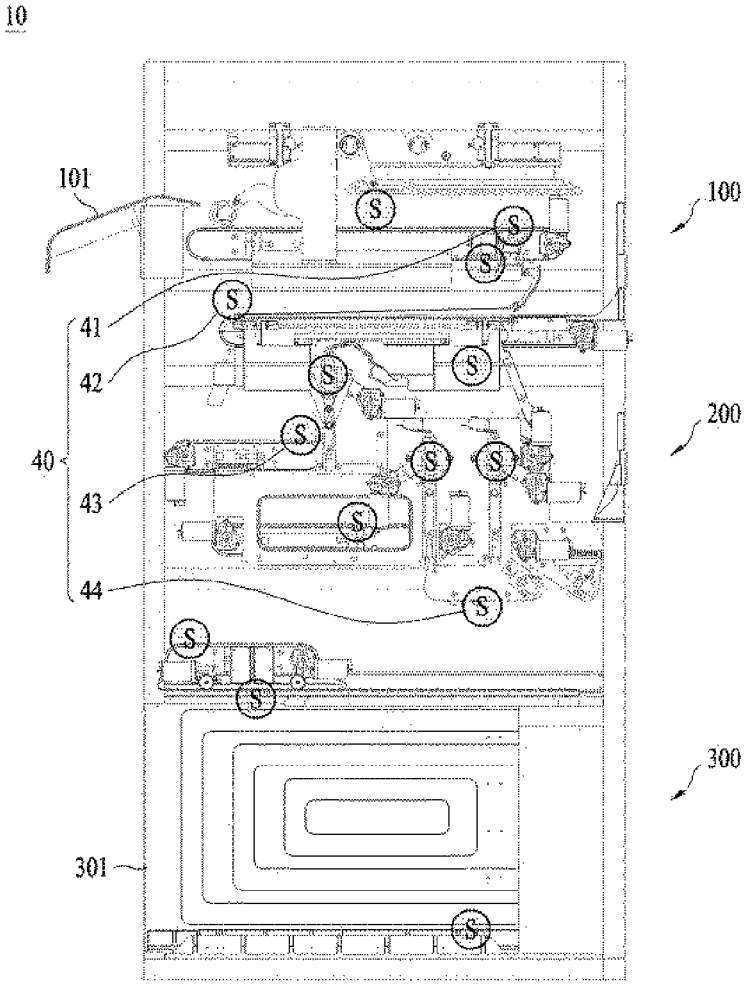
FIG. 22 is a side view illustrating a state in which sensor units according to the embodiment of the present disclosure are disposed.
Figure 23:
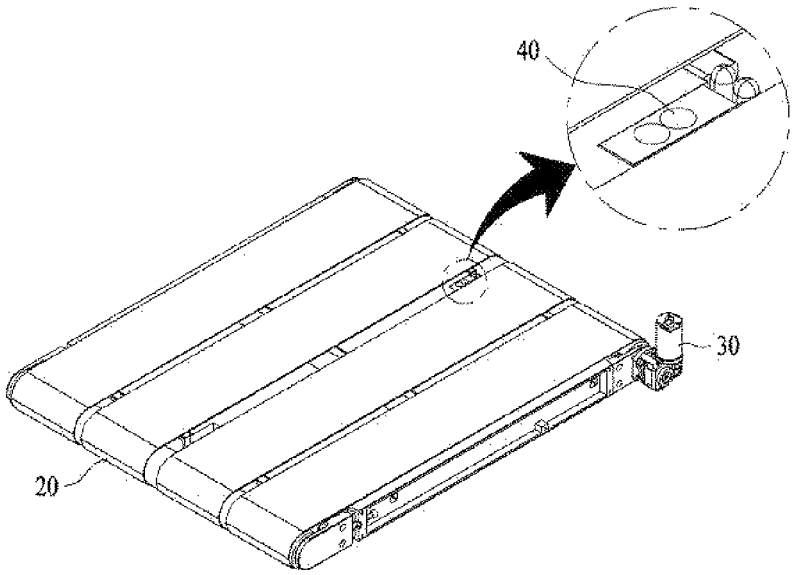
FIG. 23 is a perspective view illustrating a state in which a garment detection sensor according to the embodiment of the present disclosure is installed.
Figure 24:
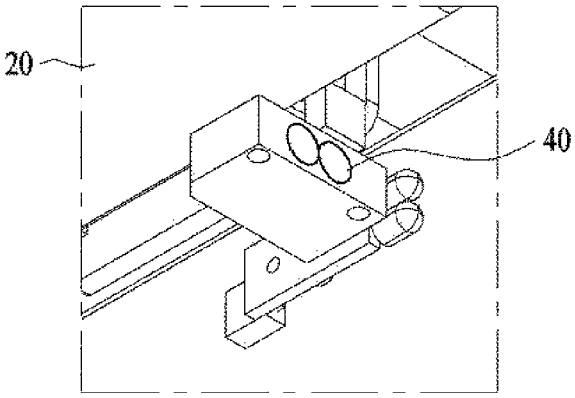
FIG. 24 is a perspective view illustrating a state in which a garment detection sensor according to another embodiment of the present disclosure is installed.
Figure 25:
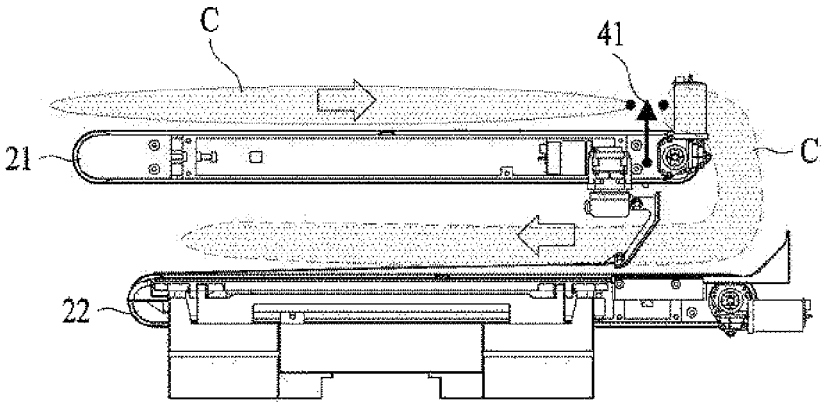
FIG. 25 is a side view illustrating a state in which the garment detection sensor of the first folding layer according to the embodiment of the present disclosure operates.
Figure 26:
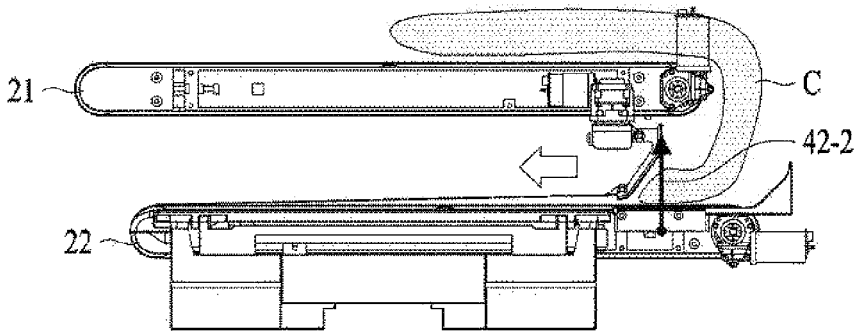
FIGS. 26 to 28 are side views illustrating states in which the garment detection sensor of the second folding layer according to the embodiment of the present disclosure operates.
Figure 27:
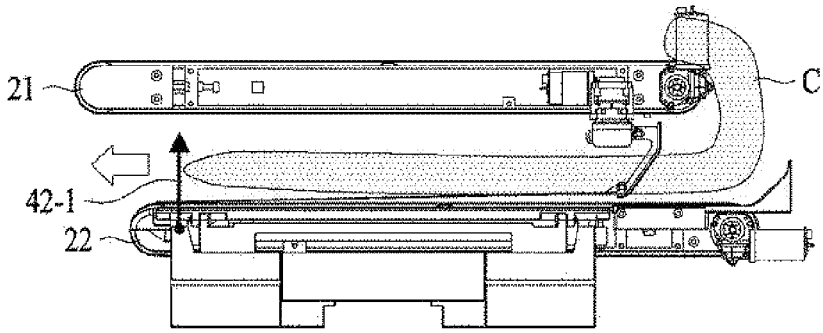
Figure 28:
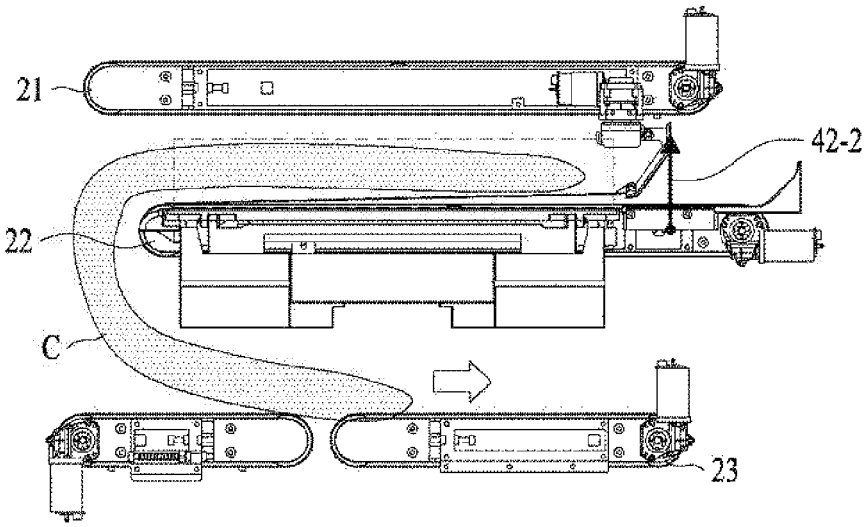
Figure 29:
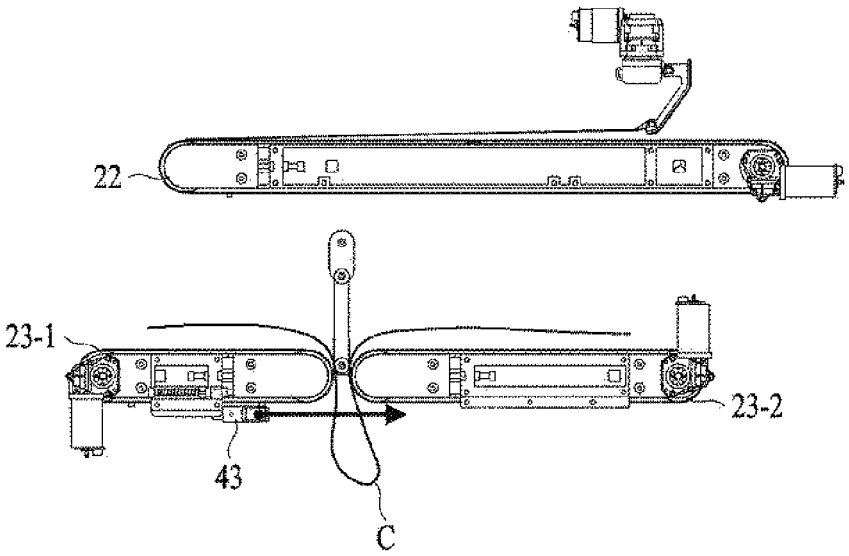
FIG. 29 is a side view illustrating a state in which the garment detection sensor of the third folding layer according to the embodiment of the present disclosure operates.
Figure 30:
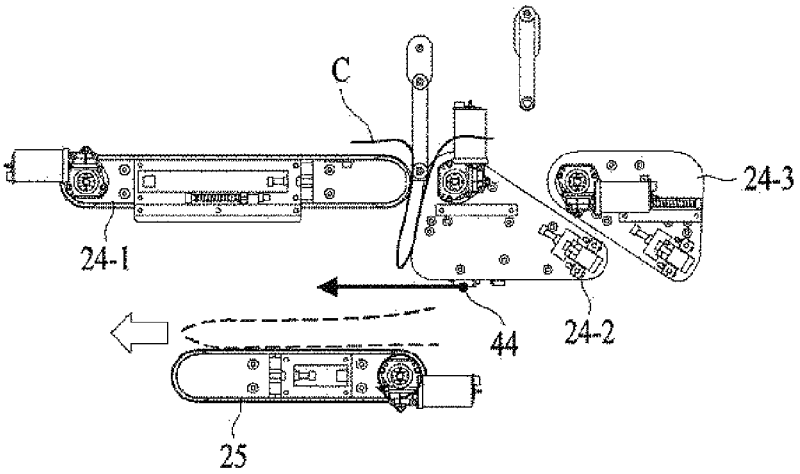
FIG. 30 is a side view illustrating a state in which the garment detection sensor of the fourth folding layer according to the embodiment of the present disclosure operates.

FIGS. 22 to 29 are views illustrating the sensor unit disposed in the garment folding apparatus according to the present disclosure, in which FIG. 22 is a side view illustrating a state in which the sensor unit according to the present disclosure is disposed, FIG. 23 is a perspective view illustrating a state in which the garment detection sensor according to the embodiment is installed, FIG. 24 is a perspective view illustrating a state in which garment detection sensor according to another embodiment is installed, FIG. 25 is a side view illustrating a state in which the garment detection sensor of the first folding layer operates, FIGS. 26 to 28 are side views illustrating states in which the garment detection sensor of the second folding layer operates, FIG. 29 is a side view illustrating a state in which the garment detection sensor of the third folding layer operates, and FIG. 30 is a side view illustrating a state in which the garment detection sensor of the fourth folding layer operates.

The sensor unit 40 includes a plurality of detection sensors configured to detect a position of the garment, a position of the assembly, pressure, or the like in the loading assembly 100, the folding assembly 200, and the unloading assembly 300. The plurality of detection sensors is provided to detect a position or length of the garment conveyed by the folding assembly 200 and an exact position of the vertical folding assembly or the horizontal folding assembly.

The folding assembly 200 includes a plurality of garment detection sensors 41, 42, 43, and 44 to recognize the positions of the garments. The garment detection sensors 41, 42, 43, and 44 may each be configured as an infrared (IR) sensor.

In the embodiment illustrated in FIG. 23, the garment detection sensor may be provided at an upper side of the conveyor 20. The garment detection sensor may be disposed between conveyor belts so that infrared rays may propagate upward. The garment detection sensor may detect the garment passing through the upper side of the conveyor, thereby recognizing whether the garment has been normally loaded or detecting a length of the garment.

In the embodiment illustrated in FIG. 24, the garment detection sensor may be provided at a lower side of the conveyor 20. The garment detection sensor may be provided on a support portion protruding downward between the conveyor belts so that infrared rays may propagate in the horizontal direction. The garment detection sensor may detect the garment dropped from the conveyor, thereby recognizing whether the garment has been normally folded or whether the garment is jammed.

Operations of the garment detection sensors in the folding layers 210, 220, 230, and 240 constituting the folding assembly 200 will be specifically described with reference to FIGS. 25 to 30.

In the embodiment illustrated in FIG. 25, the garment detection sensor 41 may be provided at a rear upper side of the conveyor 21 provided in the first folding layer 210. The above-mentioned top-emission type garment detection sensor (see FIG. 23) may be applied.

Therefore, the garment detection sensor may recognize whether the garment C is normally loaded onto the conveyor 21. In addition, a start portion and an end portion of the garment C may be detected, and a length of the garment may be recognized on the basis of the detection time and the movement speed of the conveyor. A value of the length of the garment detected by the garment detection sensor 41 is provided as basic data that may be used to determine a total number of times the garment needs to be folded or determine which folding layer the folding process needs to be performed in.

In the embodiment illustrated in FIGS. 26 to 28, the garment detection sensors 42 may be provided at rear and front upper sides of the conveyor 22 provided in the second folding layer 220. The above-mentioned top-emission type garment detection sensor (see FIG. 23) may be applied. The rear garment detection sensor 42-2 detects the garment entering the conveyor 22 (see FIG. 26). The front garment detection sensor unit 42-1 checks whether the garment is completely deployed on the conveyor 22, such that a condition in which the vertical folding assembly 222 may normally operate is implemented (see FIG. 27). When the detected length of the garment is longer than a length of the plate 2221, a part of the garment, which corresponds to the length of the plate 2221, may be conveyed by the conveyor 22, and then the second vertical folding process may be performed by the vertical folding assembly 222 (see FIG. 28). The vertical folding process may be repeated multiple times by using the same method. In this case, the rear garment detection sensor 42-2 may detect the end portion of the garment, and then the final vertical folding process may be performed. As described above, even though the length of the plate 2221 of the vertical folding assembly 222 is shorter than the length of the garment, the vertical folding process may be perfectly implemented by using the garment detection sensor 42.

In the embodiment illustrated in FIG. 29, the garment detection sensor 43 may be provided at a lower side of the conveyor 23 provided in the third folding layer 230. The above-mentioned horizontal-emission type garment detection sensor (see FIG. 24) may be applied. Specifically, the garment detection sensor 43 may be provided on the support portion protruding downward from the front conveyor 23-1 so that the infrared rays may propagate in the horizontal direction. The garment detection sensor 43 provided at the lower side of the conveyor 23 may detect the garment C passing through the folding gap 233, thereby recognizing whether the garment C has been normally folded horizontally or whether the garment is jammed.

In the embodiment illustrated in FIG. 30, the garment detection sensor 44 may be provided at a lower side of the conveyor 24 provided in the fourth folding layer 240. The above-mentioned horizontal-emission type garment detection sensor (see FIG. 24) may be applied. Specifically, the garment detection sensor 44 may be provided on the support portion protruding downward from the intermediate conveyor 24-2 so that the infrared rays may propagate in the horizontal direction. As described above, the garment detection sensor provided at the lower side of the conveyor 24 may detect the garment C passing through the folding gaps 243 and 244, thereby recognizing whether the garment C has been normally folded horizontally or whether the garment is jammed.

Figure 31:
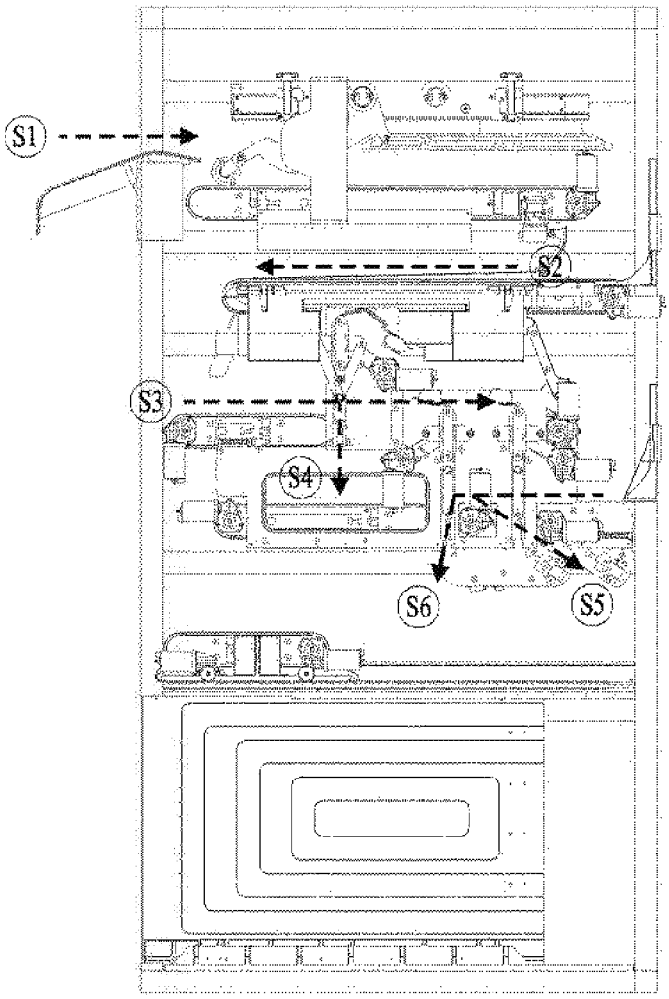
FIG. 31 is a conceptual view illustrating a garment folding method using the garment folding apparatus according to the present disclosure.
Figure 32:
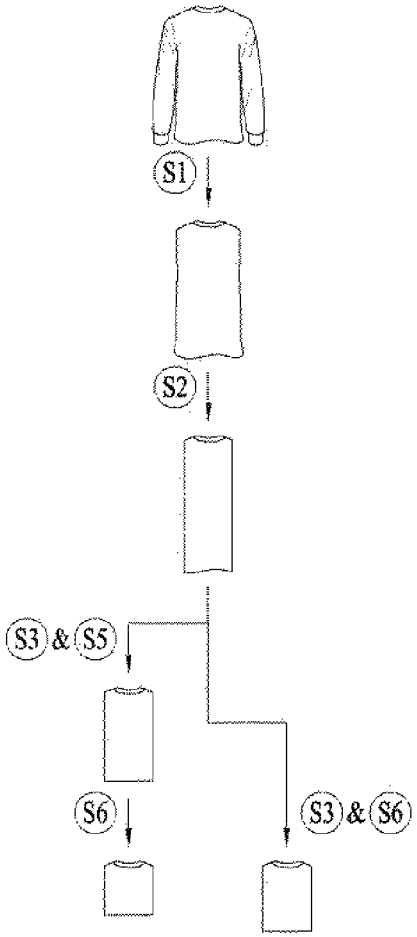
FIG. 32 is a flowchart illustrating one embodiment of the garment folding method according to the present disclosure.
Figure 33:
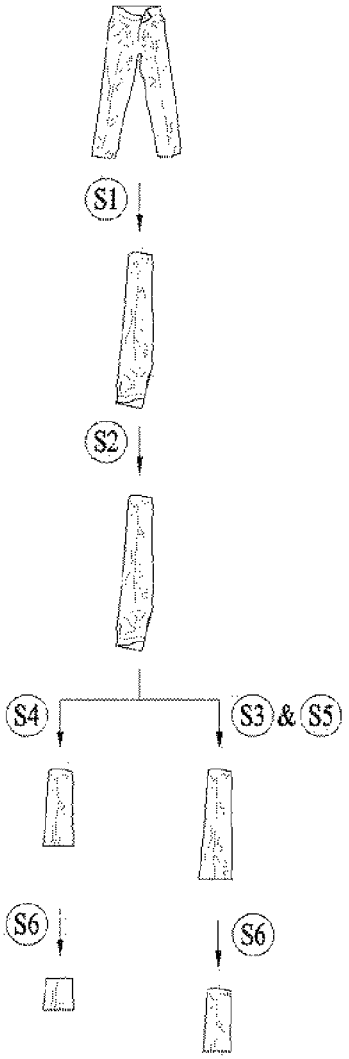
FIG. 33 is a flowchart illustrating another embodiment of the garment folding method according to the present disclosure.
Figure 34:
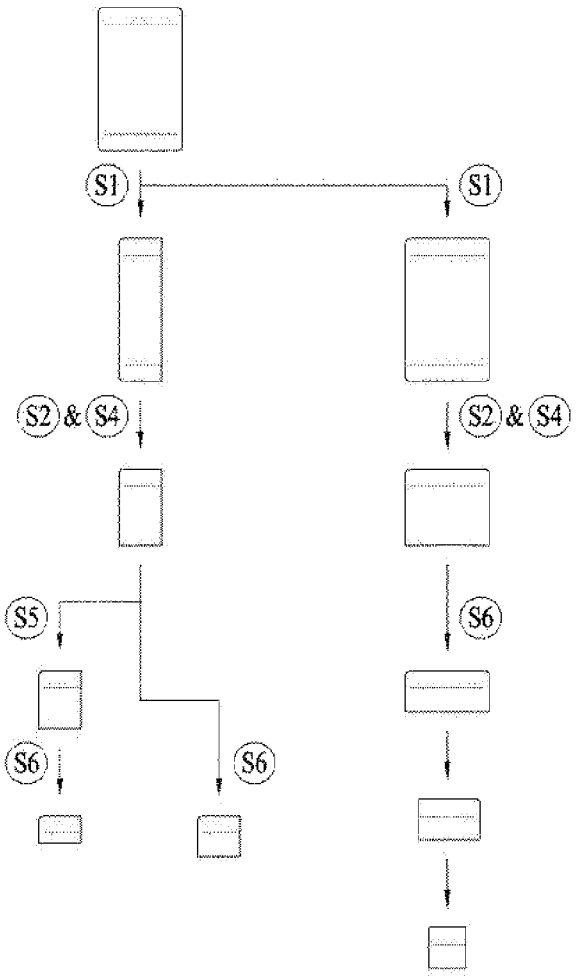
FIG. 34 is a flowchart illustrating still another embodiment of the garment folding method according to the present disclosure.

FIGS. 31 to 34 are views illustrating various garment folding methods using the garment folding apparatus according to the present disclosure, in which FIG. 31 is a conceptual view illustrating positions in the folding assembly at which the folding process is performed, FIG. 32 is a flowchart illustrating a garment folding method of folding upper garments as an embodiment, FIG. 33 is a flowchart illustrating a garment folding method of folding lower garments as an embodiment, and FIG. 34 is a flowchart illustrating a garment folding method of folding towels as an embodiment.

According to the embodiment of the folding assembly 200, the method of folding the garment loaded into the garment folding apparatus according to the present disclosure includes: a first vertical folding step S1 of folding the garment in the first folding layer 210; a second vertical folding step S2 of folding the garment in the second folding layer 220; a first horizontal folding step S3 and S4 of folding the garment in the third folding layer 230; and a second horizontal folding step S5 and S6 of folding the garment in the fourth folding layer 240.

The first horizontal folding step S3 and S4 includes a conveyance step S3 of conveying the garment to the lower folding layer without folding the garment, and a folding step S4.

The second horizontal folding step S5 and S6 includes a ⅓ folding step S5 of folding the garment at a ⅓ point based on the conveyance direction, and a ½ folding step S6 of folding the garment at a ½ point based on the conveyance direction.

In the embodiment illustrated in FIG. 32, the upper garment loaded into the garment folding apparatus according to the present disclosure may be vertically folded in the first vertical folding step S1 and the second vertical folding step S2. Thereafter, the upper garment is horizontally folded. In this regard, two embodiments will be described.

According to the first embodiment, the vertically folded garment is conveyed immediately without being folded in the third horizontal folding step (S3), and then sequentially subjected to the ⅓ folding step S5 and the ½ folding step S6 in the fourth horizontal folding step, such that the upper garment, which is completely horizontally folded in three stages, may be unloaded (see the left flowchart in FIG. 32).

According to the second embodiment, the vertically folded garment is conveyed immediately without being folded in the third horizontal folding step (S3), and then subjected only to the ½ folding step S6 in the fourth horizontal folding step, such that the upper garment, which is completely horizontally folded in four stages, may be unloaded (see the right flowchart in FIG. 32).

In the embodiment illustrated in FIG. 33, the lower garment loaded into the garment folding apparatus according to the present disclosure may be vertically folded once while passing through the first vertical folding step S1 and the second vertical folding step S2. That is, in the second vertical folding step S2, the lower garment is immediately conveyed without being folded by the vertical folding assembly. Thereafter, the lower garment is horizontally folded. In this regard, two embodiments will be described.

According to the first embodiment, the vertically folded garment is horizontally folded in the third horizontal folding step S4 and then horizontally folded in the ½ folding step S6 in the fourth horizontal folding step, such that the lower garment, which is completely horizontally folded in four stages, may be unloaded (see the left flowchart in FIG. 33).

According to the second embodiment, the vertically folded garment is conveyed immediately without being folded in the third horizontal folding step S3 and then sequentially subjected to the ⅓ folding step S5 and the ½ folding step S6 ⅓ folding step S5 and the ½ folding step S6 in the fourth horizontal folding step, such that the lower garment, which is completely horizontally folded in three stages, may be unloaded (see the right flowchart in FIG. 33).

In the embodiment illustrated in FIG. 34, the towel loaded into the garment folding apparatus according to the present disclosure is subjected to the vertical and horizontal folding steps. In this regard, three embodiments will be described.

According to the first embodiment, the loaded towel may be vertically folded once while passing through the first vertical folding step S1 and the second vertical folding step S2. That is, in the second vertical folding step S2, the towel is immediately conveyed without being folded by the vertical folding assembly. Next, after the towel is horizontally folded in the third horizontal folding step S4, the towel is sequentially subjected to the ⅓ folding step S5 and the ½ folding step S6 in the fourth horizontal folding step, such that the towel having a hand towel size and shape for being stored in a bathroom cabinet may be unloaded (see the left flowchart in FIG. 34).

According to the second embodiment, the loaded towel may be vertically folded once while passing through the first vertical folding step S1 and the second vertical folding step S2. That is, in the second vertical folding step S2, the towel is immediately conveyed without being folded by the vertical folding assembly. Next, after the towel is horizontally folded in the third horizontal folding step S4, the towel is immediately subjected to the ½ folding step S6 in the fourth horizontal folding step, such that the towel may be unloaded as a hand towel different in size and shape from the hand towel according to the first embodiment (see the intermediate flowchart in FIG. 34).

According to the third embodiment, the loaded towel is conveyed immediately without being vertically folded while passing through the first vertical folding step S1 and the second vertical folding step S2. Thereafter, after the towel is horizontally folded in the third horizontal folding step S4, the towel is immediately subjected to the ½ folding step S6 in the fourth horizontal folding step, such that the towel different in size and shape from the hand towels according to the first and second embodiments may be unloaded (see the right flowchart in FIG. 34). As another embodiment, the vertical folding layer may be further provided below the fourth folding layer so that the vertical folding process is additionally performed after the horizontal folding process is completed. In this case, a hand towel having a smaller vertical width than the towel according to the third embodiment may be unloaded and appropriately stored in an intended bathroom cabinet.

It is apparent to those skilled in the art that the present disclosure may be specified as other specific forms without departing from the spirit and the essential features of the present disclosure.

It should be appreciated that the detailed description is interpreted as being illustrative in every sense, not restrictive. The scope of the present disclosure should be determined based on the reasonable interpretation of the appended claims, and all of the modifications within the equivalent scope of the present disclosure belong to the scope of the present disclosure.

The invention claimed is:

1. A garment folding apparatus, which serves to fold a garment during a process of conveying the garment, the garment folding apparatus comprising:

a loading assembly configured to load a garment;

a folding assembly configured to fold the loaded garment while conveying the garment; and an unloading assembly disposed below the folding assembly and configured to unload a completely folded garment, wherein the folding assembly comprises:

a vertical folding layer having a conveyor and configured to vertically fold the loaded garment by using a drive motor;

a horizontal folding layer disposed below the vertical folding layer, having a conveyor, and configured to horizontally fold the loaded garment by using a drive motor; and sensor units provided in the vertical folding layer and the horizontal folding layer and configured to detect the garment so as to check whether the garment is loaded, a length of the garment, and whether the garment is folded, wherein the conveyor of the vertical folding layer and the conveyor of the horizontal folding layer are disposed in a zigzag manner, wherein the vertical folding layer comprises a vertical folding guide unit, and wherein the vertical folding guide unit comprises:

a guide blade elongated in a conveyance direction, and a guide frame configured to support the guide blade on the conveyor.

2. The garment folding apparatus of claim 1, wherein an upper conveyor and a lower conveyor are disposed in a staggered manner with a predetermined space in a horizontal direction so that the garment dropped from the upper conveyor is loaded directly onto the lower conveyor adjacent to the upper conveyor.

3. The garment folding apparatus of claim 1, wherein the guide blade is changed in position in a width direction by the drive motor.

4. The garment folding apparatus of claim 1, wherein the sensor units include a garment detection sensor configured as an IR sensor.

5. The garment folding apparatus of claim 4, wherein the garment detection sensor is disposed above the conveyor of the vertical folding layer and emits infrared rays upward.

6. The garment folding apparatus of claim 5, wherein the garment detection sensor of the vertical folding layer is provided between conveyor belts.

7. The garment folding apparatus of claim 5, wherein the garment detection sensor protrudes from a lower side of the conveyor of the horizontal folding layer and emits infrared rays horizontally.

8. A garment folding apparatus, which serves to fold a garment during a process of conveying the garment, the garment folding apparatus comprising:

a folding assembly configured to fold a loaded garment while conveying the garment, wherein the folding assembly comprises:

a first folding layer having a conveyor and configured to vertically fold the loaded garment;

a second folding layer disposed below the first folding layer and configured to selectively vertically fold the loaded garment by using a drive motor;

a third folding layer disposed below the second folding layer and configured to selectively horizontally fold the loaded garment by using a drive motor;

a fourth folding layer disposed below the third folding layer and configured to horizontally fold the loaded garment at least once by using a drive motor; and sensor units provided in at least one of the first or second folding layer and at least one of the third or fourth folding layer and configured to detect the garment so as to check whether the garment is loaded, a length of the garment, and whether the garment is folded, wherein the conveyors of the first to fourth folding layers are disposed in a zigzag manner, wherein the second folding layer comprises a vertical folding guide unit, and wherein the vertical folding guide unit comprises:

a guide blade elongated in a conveyance direction, and a guide frame configured to support the guide blade on the conveyor of the first folding layer.

9. The garment folding apparatus of claim 8, wherein the folding assembly comprises an unloading layer disposed below the fourth folding layer and having a conveyor configured to be movable forward or rearward.

10. The garment folding apparatus of claim 8, wherein the guide blade is changed in position in a width direction by the drive motor.

11. The garment folding apparatus of claim 8, wherein an upper conveyor and a lower conveyor are disposed in a staggered manner with a predetermined space in a horizontal direction so that the garment dropped from the upper conveyor is loaded directly onto the lower conveyor adjacent to the upper conveyor.

* * * * *